US008739475B2

(12) United States Patent
Michaud et al.

(10) Patent No.: US 8,739,475 B2
(45) Date of Patent: Jun. 3, 2014

(54) FOLDABLE BUILDING UNITS

(75) Inventors: Dennis Michaud, Waltham, MA (US); Elizabeth Rothwell, Waltham, MA (US); Everett Morton, Waltham, MA (US); Steven Eason, Waltham, MA (US); Paul Kassabian, Waltham, MA (US)

(73) Assignee: Blu Homes, Inc., Waltham, MA (US)

( * ) Notice: Subject to any disclaimer, the term of this patent is extended or adjusted under 35 U.S.C. 154(b) by 0 days.

(21) Appl. No.: 13/814,326

(22) PCT Filed: Mar. 23, 2011

(86) PCT No.: PCT/US2011/029643

§ 371 (c)(1),
(2), (4) Date: Feb. 5, 2013

(87) PCT Pub. No.: WO2012/018413

PCT Pub. Date: Feb. 9, 2012

(65) Prior Publication Data

US 2013/0133273 A1 May 30, 2013

Related U.S. Application Data

(60) Provisional application No. 61/371,509, filed on Aug. 6, 2010, provisional application No. 61/371,545, filed on Aug. 6, 2010, provisional application No.

(Continued)

(51) Int. Cl.
*E04H 1/00* (2006.01)
*E04H 14/00* (2006.01)

(52) U.S. Cl.
USPC ..... 52/79.5; 52/71; 52/97; 52/166

(58) Field of Classification Search
USPC ..... 52/66, 71, 79.5, 97
See application file for complete search history.

(56) References Cited

U.S. PATENT DOCUMENTS 2,291,472 A * 7/1942 Johnston ..... 105/375
2,592,410 A 4/1952 Shumaker (Continued)

FOREIGN PATENT DOCUMENTS

AU 460549 4/1975
CA 908382 A 8/1972

(Continued)

OTHER PUBLICATIONS

Notification of Transmittal of the International Search Report and the Written Opinion of the International Searching Authority, or the Declaration; International Application No. PCT/US2010/050041, entitled "Foldable Building Units", International Filing Date: Sep. 23, 2010, Date of Mailing: Jan. 31, 2011.

(Continued)

*Primary Examiner* — Charles A Fox
*Assistant Examiner* — Joseph J Sadlon
(74) *Attorney, Agent, or Firm* — Hamilton, Brook, Smith & Reynolds, P.C.

(57) ABSTRACT

Foldable building units are provided based on structural frame and connection assembly designs that enable greater construction efficiency and flexibility. The structural frame and connection assembly designs allow for easier connection of frame elements in the prefabrication process of the foldable building units and for easier connection of frame elements at the building site, for example, of foldably connected frame elements after unfolding. They also allow for more finish in the prefabrication process, and/or less and faster work at the building site, for example, by enabling conventional structural lumber grids that can be continuous through the edges and corners of the building envelope for conventional exterior finishing, while providing a tight building envelope with reduced heat transfer, particularly, through the edges of the foldable building unit.

31 Claims, 19 Drawing Sheets

Related U.S. Application Data

61/401,050, filed on Aug. 6, 2010, provisional application No. 61/371,497, filed on Aug. 6, 2010, provisional application No. 61/371,548, filed on Aug. 6, 2010, provisional application No. 61/371,506, filed on Aug. 6, 2010, provisional application No. 61/371,493, filed on Aug. 6, 2010, provisional application No. 61/371,536, filed on Aug. 6, 2010, provisional application No. 61/401,049, filed on Aug. 6, 2010.

(56) References Cited

U.S. PATENT DOCUMENTS

| | | | | |
|---|---|---|---|---|
| 2,592,610 | A * | 4/1952 | Shumaker | 52/69 |
| 3,189,949 | A | 6/1965 | Hurkamp | |
| 3,253,371 | A | 5/1966 | Honold et al. | |
| 3,338,005 | A | 8/1967 | Gelsavage | |
| 3,348,344 | A | 10/1967 | Tatevossian | |
| 3,714,749 | A | 2/1973 | Aitken | |
| 3,774,356 | A * | 11/1973 | Philp | 52/70 |
| 3,782,063 | A | 1/1974 | Batorewicz et al. | |
| 3,832,811 | A | 9/1974 | Briel, Jr. | |
| 3,835,600 | A | 9/1974 | Padula et al. | |
| 3,844,083 | A | 10/1974 | Farley, Jr. | |
| 3,969,869 | A | 7/1976 | Partridge | |
| 3,971,185 | A | 7/1976 | Hendrich | |
| 3,984,948 | A | 10/1976 | Bussard | |
| 4,085,762 | A * | 4/1978 | O'Brian et al. | 52/71 |
| 4,235,054 | A | 11/1980 | Cable et al. | |
| 4,479,333 | A | 10/1984 | Hendrich | |
| 4,545,171 | A | 10/1985 | Colvin | |
| 4,546,578 | A | 10/1985 | Behrmann | |
| 4,588,190 | A | 5/1986 | Stewart et al. | |
| 4,635,412 | A | 1/1987 | LePoittevin | |
| 4,660,332 | A | 4/1987 | Colvin, Jr. | |
| 4,662,146 | A | 5/1987 | Parry | |
| 4,689,924 | A | 9/1987 | Jurgensen | |
| 4,715,159 | A | 12/1987 | Hijazi | |
| 4,726,155 | A | 2/1988 | Nahmias | |
| 4,742,653 | A | 5/1988 | Napier et al. | |
| 4,891,919 | A | 1/1990 | Palibroda | |
| 4,903,637 | A * | 2/1990 | Devault | 119/497 |
| 4,912,891 | A | 4/1990 | Bertrand | |
| 4,942,686 | A | 7/1990 | Kemeny | |
| 5,107,639 | A | 4/1992 | Morin et al. | |
| 5,237,784 | A | 8/1993 | Ros | |
| 5,398,498 | A | 3/1995 | Mort et al. | |
| 5,444,944 | A | 8/1995 | Roelofsz | |
| 5,461,832 | A | 10/1995 | Smith | |
| 5,611,449 | A | 3/1997 | Pedersen | |
| 5,657,606 | A | 8/1997 | Ressel et al. | |
| 5,761,854 | A | 6/1998 | Johnson et al. | |
| 5,960,593 | A | 10/1999 | Murphy | |
| 5,966,956 | A | 10/1999 | Morris et al. | |
| 6,125,608 | A | 10/2000 | Charlson | |
| 6,345,471 | B1 | 2/2002 | Gyllenhammar | |
| 6,434,895 | B1 | 8/2002 | Hosterman et al. | |
| 6,460,297 | B1 | 10/2002 | Bonds et al. | |
| 6,550,209 | B2 * | 4/2003 | Meguro et al. | 52/653.1 |
| 6,749,252 | B2 * | 6/2004 | Cervenka | 296/165 |
| 6,892,504 | B1 | 5/2005 | diGirolamo et al. | |
| 6,983,567 | B2 | 1/2006 | Ciotti | |
| 7,418,802 | B2 | 9/2008 | Sarine et al. | |
| 7,475,514 | B2 | 1/2009 | Rulquin et al. | |
| 7,562,508 | B2 | 7/2009 | Dickinson et al. | |
| 7,637,060 | B2 | 12/2009 | Starheim et al. | |
| 7,647,731 | B2 | 1/2010 | Muir | |
| 7,658,039 | B2 | 2/2010 | Ziegelman | |
| 7,841,136 | B2 | 11/2010 | Czyznikiewicz | |
| 7,895,794 | B2 | 3/2011 | Pope | |
| 7,921,608 | B2 | 4/2011 | Bucher et al. | |
| 7,931,164 | B2 | 4/2011 | Krohn | |
| 8,156,691 | B2 | 4/2012 | Dickson et al. | |
| 8,201,362 | B2 | 6/2012 | Alford et al. | |
| 8,286,391 | B2 | 10/2012 | Yang et al. | |
| 8,322,086 | B2 | 12/2012 | Weber | |
| 8,347,560 | B2 | 1/2013 | Gyory et al. | |
| 2001/0005967 | A1 * | 7/2001 | Meguro et al. | 52/653.1 |
| 2002/0007605 | A1 * | 1/2002 | Cohen et al. | 52/238.1 |
| 2002/0062605 | A1 | 5/2002 | Matthews | |
| 2003/0145537 | A1 | 8/2003 | Bailey | |
| 2004/0083671 | A1 | 5/2004 | Johnson et al. | |
| 2004/0194396 | A1 | 10/2004 | Shanni | |
| 2005/0044804 | A1 | 3/2005 | Bin et al. | |
| 2005/0210764 | A1 | 9/2005 | Foucher et al. | |
| 2005/0284035 | A1 | 12/2005 | DeOvando et al. | |
| 2006/0053701 | A1 | 3/2006 | Loesch | |
| 2006/0059792 | A1 | 3/2006 | Tiramani | |
| 2006/0225369 | A1 | 10/2006 | Napier | |
| 2007/0079573 | A1 | 4/2007 | Sarine et al. | |
| 2008/0163564 | A1 | 7/2008 | Jarski | |
| 2008/0236055 | A1 | 10/2008 | Laprise | |
| 2009/0193725 | A1 | 8/2009 | Harrisson et al. | |
| 2009/0313925 | A1 | 12/2009 | Lyons et al. | |
| 2010/0043308 | A1 | 2/2010 | Keeble | |
| 2010/0064601 | A1 | 3/2010 | Napier | |
| 2010/0218436 | A1 | 9/2010 | Colquhoun | |
| 2011/0214362 | A1 | 9/2011 | Huang | |
| 2012/0186166 | A1 | 7/2012 | Casto | |
| 2012/0255240 | A1 | 10/2012 | Shen | |
| 2012/0279142 | A1 | 11/2012 | Michaud | |
| 2012/0311939 | A1 | 12/2012 | Barragan Olaya | |
| 2012/0317898 | A1 | 12/2012 | Strachan et al. | |
| 2013/0014450 | A1 | 1/2013 | Esposito | |
| 2013/0133273 | A1 | 5/2013 | Michaud et al. | |
| 2013/0192146 | A1 | 8/2013 | Anklam | |
| 2013/0192147 | A1 | 8/2013 | Schaffert | |
| 2013/0232887 | A1 | 9/2013 | Donnini | |
| 2013/0269267 | A1 | 10/2013 | Tiramani | |
| 2013/0305628 | A1 | 11/2013 | Warner et al. | |
| 2014/0059947 | A1 | 3/2014 | Rothwell et al. | |

FOREIGN PATENT DOCUMENTS

| | | | |
|---|---|---|---|
| CA | 962422 | | 2/1975 |
| CA | 2 591 949 | | 6/2006 |
| DE | 7102932 | U | 1/1971 |
| DE | 2364021 | A1 | 3/1975 |
| EP | 1 775 396 | A1 | 4/2007 |
| EP | 1 975 329 | A1 | 10/2008 |
| GB | 330609 | | 6/1930 |
| GB | 449755 | | 6/1936 |
| GB | 1021 625 | | 3/1966 |
| GB | 1 343 437 | | 1/1974 |
| GB | 2029474 | A | 3/1980 |
| GB | 1 581 581 | A | 12/1980 |
| GB | 2 296 728 | A | 7/1996 |
| GB | 2350131 | A | 11/2000 |
| GB | 2415713 | A | 1/2006 |
| WO | WO 91/02869 | | 3/1991 |
| WO | WO 93/20297 | | 10/1993 |
| WO | WO 02/066755 | A1 | 8/2002 |
| WO | WO 2007/033498 | A1 | 3/2007 |
| WO | WO 2008/009039 | A1 | 1/2008 |
| WO | WO 2009/059432 | A1 | 5/2009 |
| WO | WO 2009/126985 | A1 | 10/2009 |
| WO | WO 2010/057313 | A1 | 5/2010 |

OTHER PUBLICATIONS

Jetson Green, Blu Perfects Iconic Breezehouse Prefab, [online] http:///www.jetsongreen.com/2011/01/blu-perfects-icon-breeze-way-house.html: [Retrieved from the Internet on Jan. 23, 2012.].

Notification Concerning Transmittal of International Preliminary Report on Patentability, International Application No. PCT/US2010/050041, International Filing Date: Sep. 23, 2010, entitled "Foldable Building Units", Date of Mailing: Apr. 5, 2012.

International Search Report and the Written Opinion of the International Searching Authority, or the Declaration, International Application No. PCT/US2011/054348, entitled "Buildings Formed From Complementary Building Modules, and Methods for Building Same", International Filing Date: Sep. 30, 2011, Date of Mailing: Aug. 16, 2012.

(56) References Cited

OTHER PUBLICATIONS

International Search Report and the Written Opinion of the International Searching Authority, or the Declaration, International Application No. PCT/US2011/029643, entitled "Foldable Building Units", International Filing Date: Mar. 23, 2011; Date of Mailing: May 23, 2011.

International Preliminary Report on Patentability, International Application No. PCT/US2011/029643, entitled "Foldable Building Units", International Filing Date: Mar. 23, 2011; Date of Mailing: Feb. 21, 2013.

International Preliminary Report on Patentability, International Application No. PCT/US2011/054348, entitled "Buildings Formed From Complementary Building Modules, and Methods for Building Same", International Filing Date: Sep. 30, 2011; Date of Mailing: Apr. 11, 2013.

International Search Report and the Written Opinion of the International Searching Authority, or the Declaration, International Application No. PCT/US2012/022419, entitled "Dual-Side Unfoldable Building Modules", International Filing Date: Jan. 24, 2012; Date of Mailing: May 4, 2012.

International Preliminary Report on Patentability, International Application No. PCT/US2012/022419, entitled "Dual-Side Unfoldable Building Modules", International Filing Date: Jan. 24, 2012; Date of Mailing: Aug. 8, 2013.

Office Action, U.S. Appl. No. 13/498,093, entitled "Foldable Building Units", filed Sep. 23, 2010, Date of Mailing: Jan. 25, 2013.

Office Action, U.S. Appl. No. 13/498,093, entitled "Foldable Building Units", filed Sep. 23, 2010, Date of Mailing: Nov. 6, 2013.

* cited by examiner

1145

1115

1140

1135
1125

1130

1120
1150
1205

1105
1110

FOLDABLE BUILDING UNITS

RELATED APPLICATIONS

This application is the U.S. National Stage of International Application No. PCT/US2011/029643, filed Mar. 23, 2011, which designates the U.S., published in English, and claims the benefit of U.S. Provisional Application No. 61,371,493, filed Aug. 6, 2010, U.S. Provisional Application No. 61/371,509 filed Aug. 6, 2010, U.S. Provisional Application No. 61/401,049, filed Aug. 6, 2010, U.S. Provisional Application No. 61/401,050, filed Aug. 6, 2010, U.S. Provisional Application No. 61/371,536, filed Aug. 6, 2010, U.S. Provisional Application No. 61/371,545, filed Aug. 6, 2010, U.S. Provisional Application No. 61/371,548, filed Aug. 6, 2010, U.S. Provisional Application No. 61/371,497, filed Aug. 6, 2010, and U.S. Provisional Application No. 61/371,506, filed Aug. 6, 2010. The entire teachings of the above applications are incorporated herein by reference.

BACKGROUND OF THE INVENTION

Foldable building units have previously mostly been described in the literature. Reasons that hinder commercialization of previously described foldable building units include the large extent of work that needs to be performed at the building site, the difficulty of ensuring that prefabricated finished interior and exterior surfaces can be transported without substantial damage, and the generally increased complexity of constructing a foldable building unit.

There is, therefore, a need for foldable building units with new structural frame and connection assembly designs enabling greater construction efficiency and flexibility, in particular, structural frame and connection assembly designs allowing for easier connection of frame elements in the prefabrication process and at the building site, allowing for more finish in the factory, and less and faster work at the building site, while providing a tight building envelope with reduced heat transfer, particularly, through the edges of the foldable building unit.

SUMMARY OF THE INVENTION

A first embodiment of the present invention is a foldable building unit. The foldable building unit includes (a) a first frame element having a first structural load carrying member that is a hollow structural metal section, a metal C-channel, a metal I-beam, a metal T-beam, a metal angle beam, or a metal wide-flange beam; (b) a second frame element having a second structural load carrying member that is a hollow structural metal section, a metal C-channel, a metal I-beam, a metal T-beam, or a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other.

A second embodiment of the present invention is a foldable building envelope that is substantially entirely formed by panels that are connected through structural load carrying members of the panels, which are, independently, a hollow structural metal section, a metal C-channel, a metal I-beam, a metal T-beam, a metal angle beam, or a metal wide-flange beam, the structural load carrying members being part of a metal structural frame of the foldable building envelope, the panels including interior and exterior finishing material attached to blocking members, the blocking members being attached to the structural load carrying members; and structural load carrying members in at least some of the edges of the foldable building envelope having blocking members directly lengthwise attached to one or more interior surfaces of the structural load carrying members in a manner that allows exterior finishing material to be affixed to blocking members in the edges of the foldable building envelope.

A third embodiment of the present invention is a foldable building unit, comprising a first panel including a first structural frame having a first structural load carrying member and a second panel including a second structural frame having a second structural load carrying member; wherein the first structural load carrying member and the second structural load carrying member are lengthwise affixed to each other such that the first and second panel form an exterior edge; at least one of the first or second structural load carrying member having a blocking member lengthwise affixed to one or more of its interior surfaces, and the blocking member positioned such that exterior finishing material is directly attachable to the blocking member in unfolded configuration.

The foldable building units of the present invention have one or more of the following advantages. They can be easily prefabricated, allow precision unfolding, allow easy fastening of foldably connected frame elements in unfolded configuration, allow to insulate metal structural load carrying members in the edges and corners of the foldable building units thereby reducing heat transfer, they allow easy fastening of finish material in the edges and corners, and they allow foldable building units that are more compact in the folded configuration thereby allowing larger foldable building units to be transported more easily.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Foldable building units of the present invention are based on new structural frame and connection assembly designs enabling greater construction efficiency and flexibility. The structural frame and connection assembly designs allow for easier connection of frame elements in the prefabrication process of the foldable building units and for easier connection of frame elements at the building site, for example, of foldably connected frame elements after unfolding. They also allow for more finish in the prefabrication process and/or less and faster work at the building site while providing a tight building envelope with reduced heat transfer, particularly, through the edges of the foldable building unit.

A description of example embodiments of the invention follows.

Figure 1:
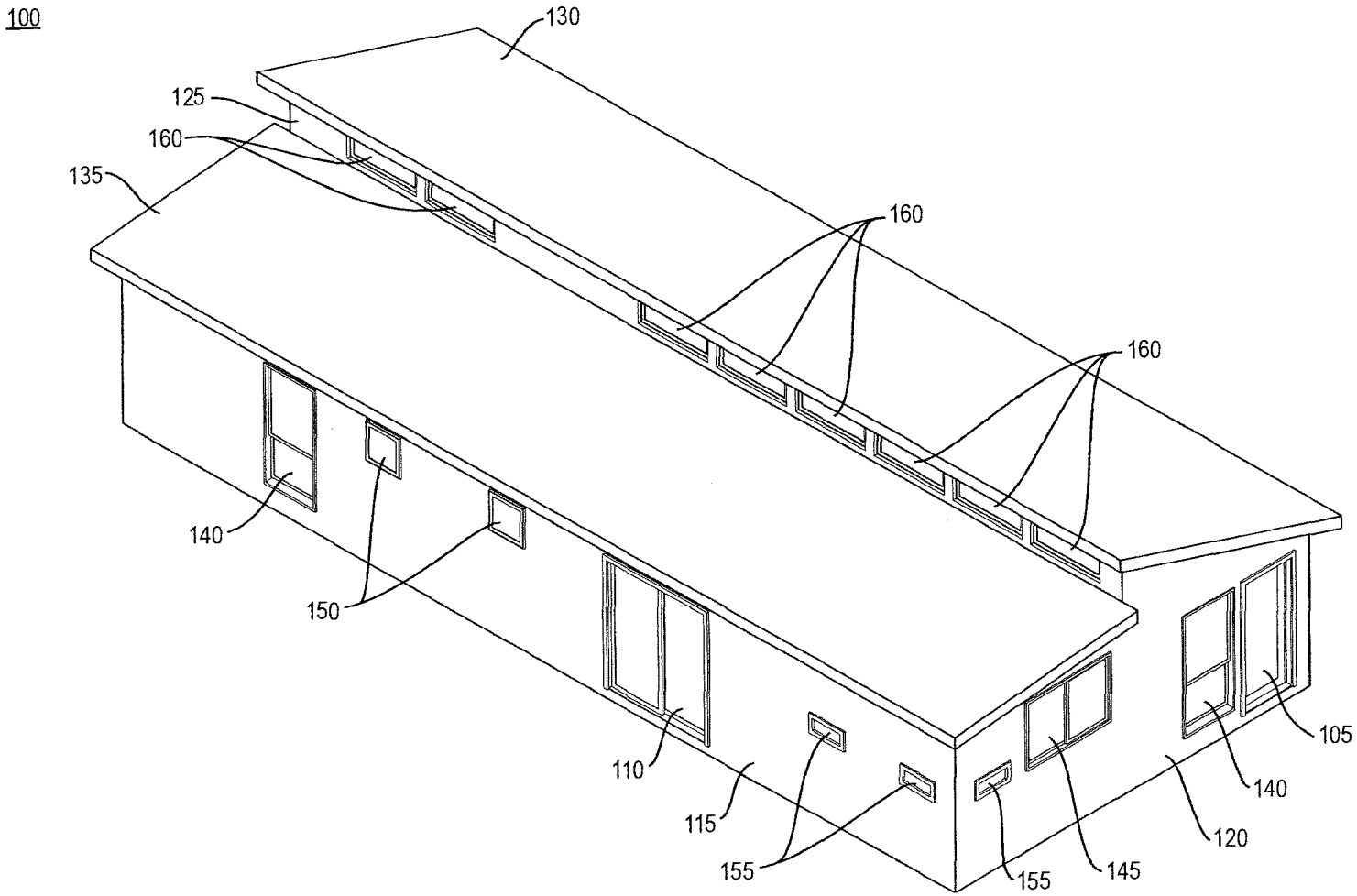
FIG. 1 is a schematic axonometric view of an exemplary foldable building unit of the present invention in unfolded configuration.

FIG. 1 is a schematic axonometric view of an exemplary foldable building unit of the present invention. In this embodiment, the foldable building unit, in unfolded configuration, is a substantially finished residential building (100). The foldable building unit is fabricated from a number of panels that form, for example, the shown outside walls, for example, front wall (115), side wall (120), clerestory wall (125), ceiling and roof (130), and roof (135). Typically, doors (e.g. entrance door (105), sliding door and window (110)) and windows (140, 145, 150, 155 and 160) are prefabricated and included in the folded building unit.

Figure 2:
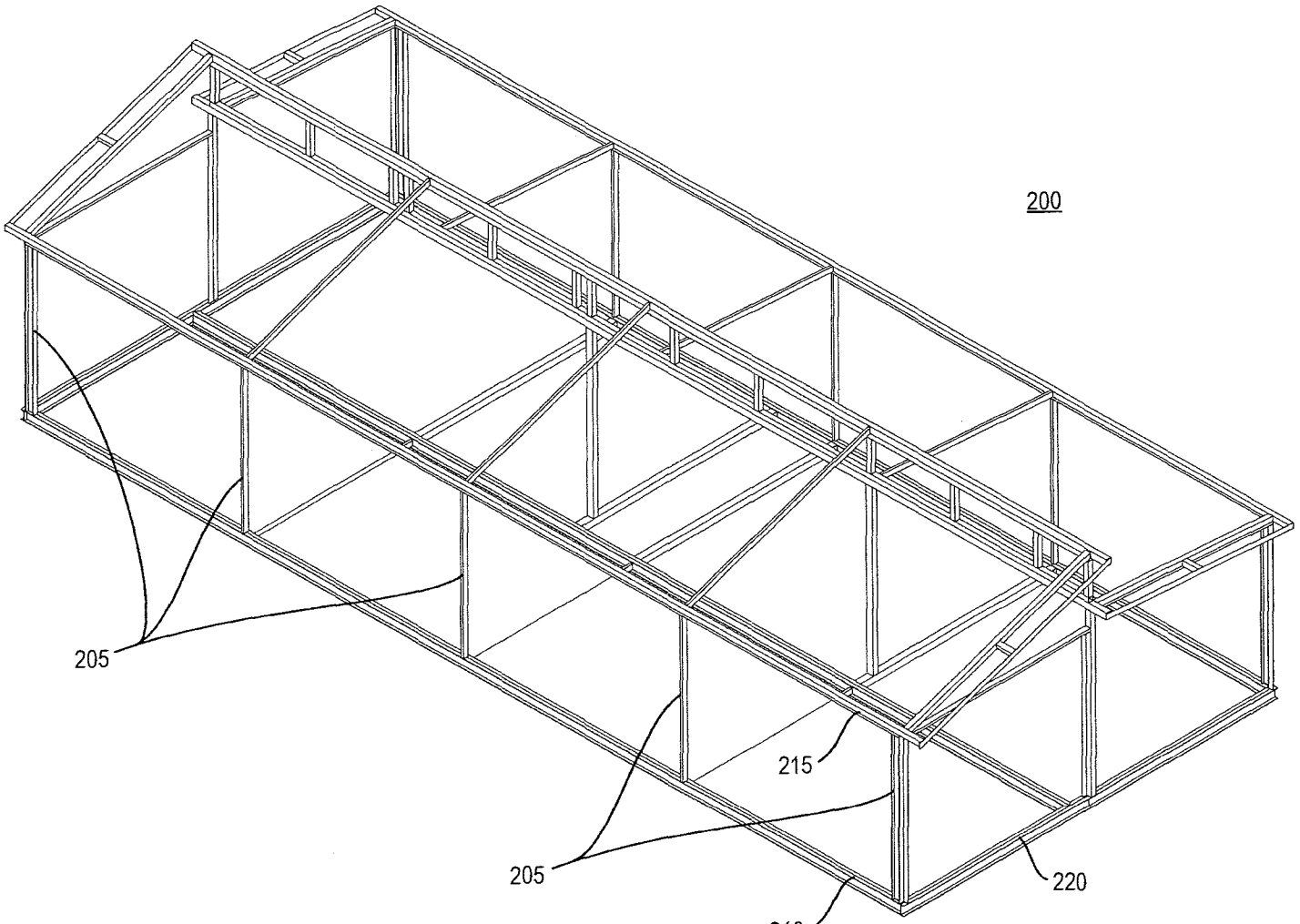
FIG. 2 is a schematic axonometric view of the foldable structural steel frame of the foldable building unit of FIG. 1.

FIG. 2 is a schematic axonometric view of the foldable structural steel frame 200 of the foldable building unit 100 (hinges are not shown). In this embodiment, the shown structural steel frame is made entirely from structural load carrying steel members such as members 205, 210 and 215. Structural load carrying members can be connected to provide a fixed connection in both folded and unfolded configuration of the foldable building unit, for example, structural load carrying members 205 are in fixed connection with, for example, structural load carrying member 210. Other structural load carrying members such as structural load carrying members 210 and 220 are foldably connected to allow folding and unfolding of the foldable building unit, and are affixed after unfolding at the building site.

Figure 3:
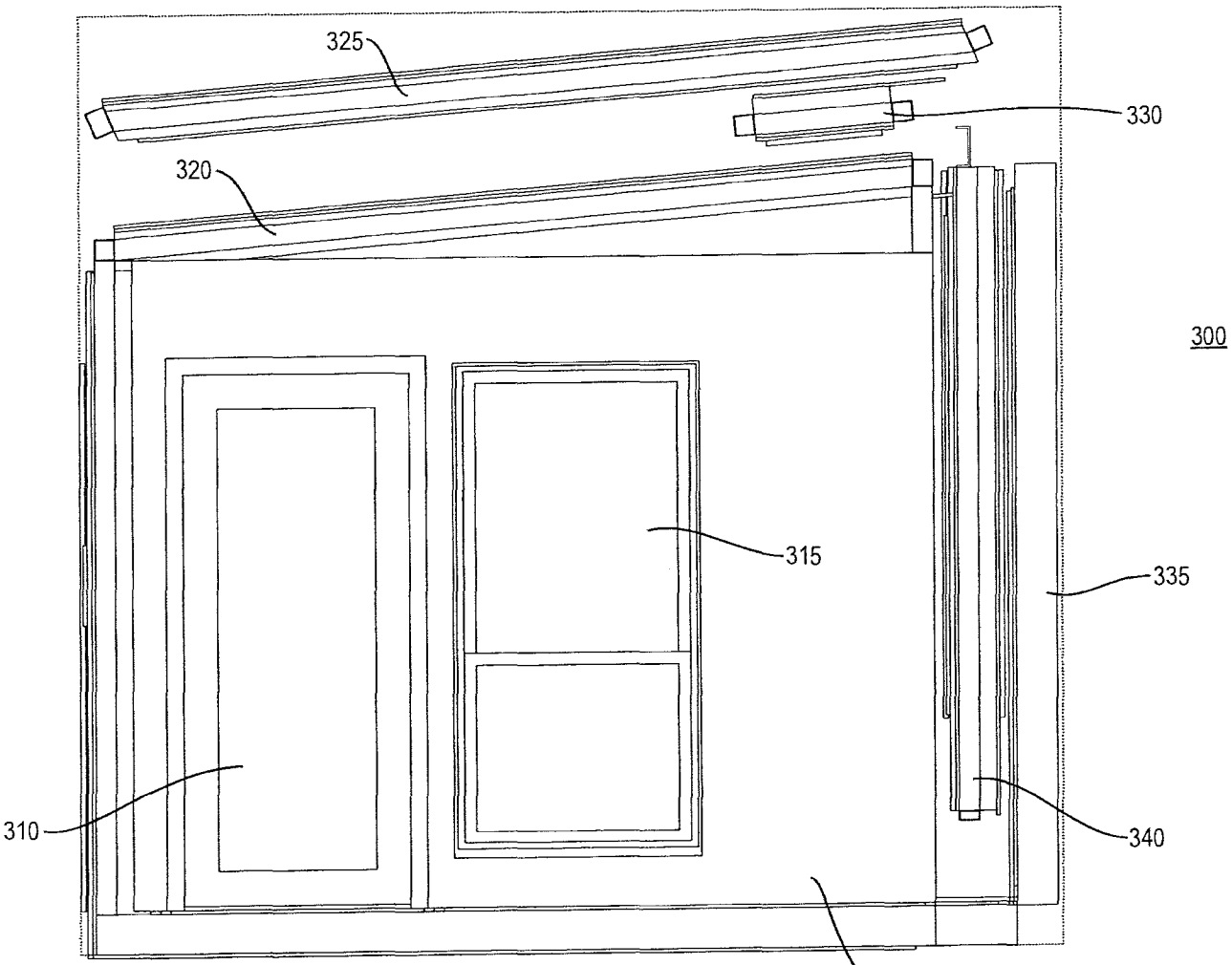
FIG. 3 is a schematic side view of the foldable building unit of FIG. 1 in folded configuration.

FIG. 3 is a schematic side view of the foldable building unit 100 in folded configuration (300). Because door 205 and window 240 are part of a foldably connected wall panel 305 that is shown in folded position, the interior side 310 of door 205 and the interior side 315 of window 240 is here visible. Further panels shown include roof panels 320 and 325, clerestory wall panel 330, floor panel 335 and side wall panel 340. The height of this foldable building unit in folded configuration is, for example, 11 feet and 6 inches and the width is, for example, 12 feet. The length of the foldable building unit is, for example, 50 feet. In unfolded configuration such a foldable building unit would have an area of about 940 square feet.

Figure 4:
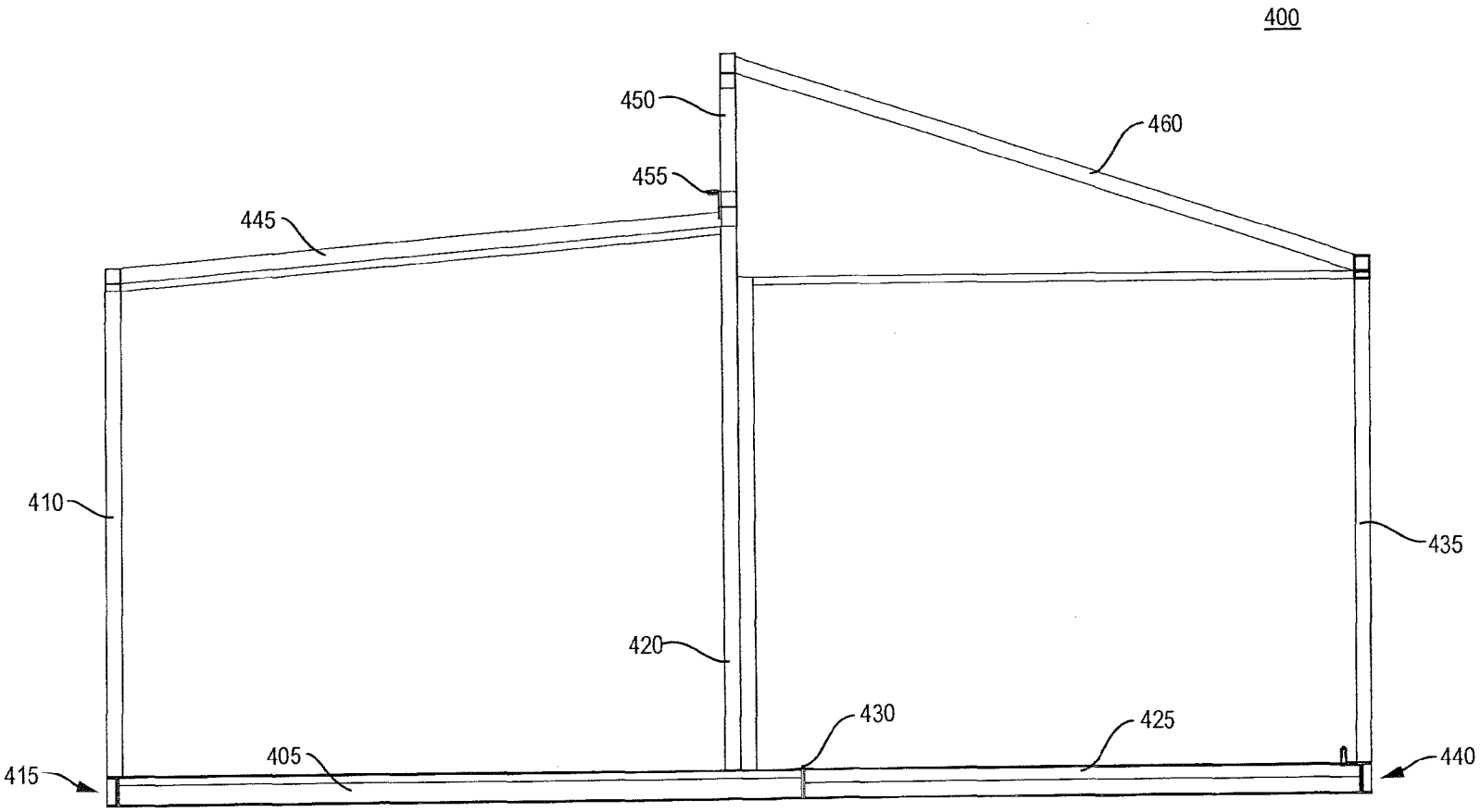
FIG. 4 is a schematic side view of the foldable structural steel frame of FIG. 2.

FIG. 4 is a schematic side view 400 of the foldable structural steel frame 200. The floor frame element 405 has a fixed connection with rear wall frame element 410 through connection detail 415, a fixed connection with structural load carrying member 420, and a hinged connection with floor frame element 425 through connection detail 430. The floor frame element 425 has a hinged connection with front wall frame element 435 through connection detail 440. The roof frame element 445 has a fixed connection with the rear wall frame element 410 and structural load carrying member 420. The clerestory frame element 450 is foldably connected with roof frame element 445 (but it can also be designed to be foldably connected structural load carrying member 420) through connection detail 455, and is prepared for a fixed connection with roof frame element 460, which itself is designed for a fixed connection with front wall frame element 435. Panelized roof frame element 460 is designed to be affixed at the building site. Also, at the building site, foldably connected frame elements and are typically affixed to each other after unfolding into unfolded configuration.

Figure 5:
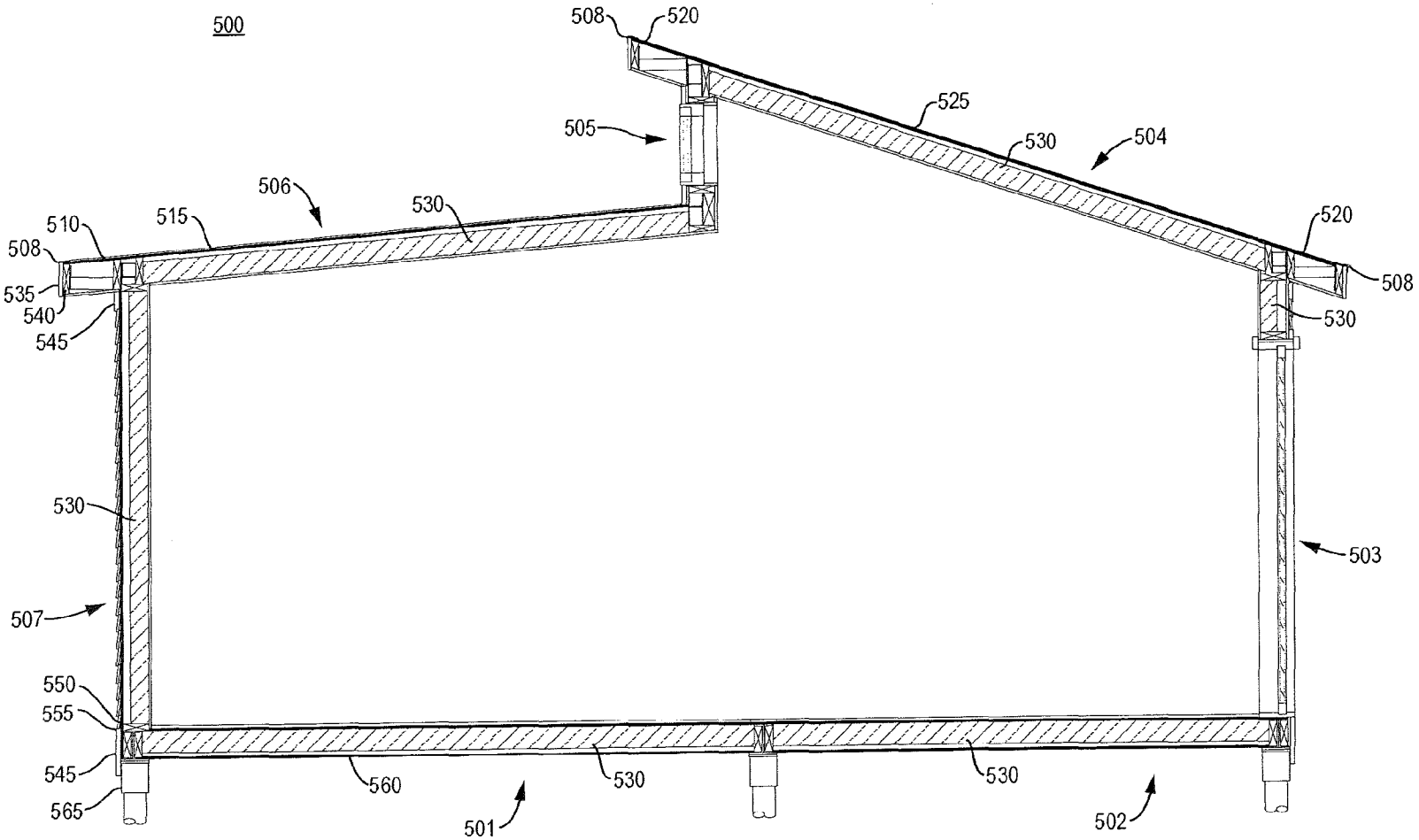
FIG. 5 is a schematic side view of a foldable building unit of the present invention (such as the one of FIG. 1) providing views of several connected panels.

FIG. 5 is a schematic side view 500 of a foldable building unit of the present invention (such as foldable building unit 100) providing views of several connected panels 501 to 507. The roof includes metal drip edges 508, roofing 510 (e.g. rubber roofing such as ethylene propylene diene monomer rubber (EPDM)), roof sheathing 515, ice and water shield 520, shingles 525 (e.g., asphalt shingles), and insulation 530 (e.g., closed-cell spray foam). The figure further shows fascia 535, subfascia 540, trim boards 545 of different sizes, tape flashing 550, flashing 555 (e.g., Z-flashing), plywood (e.g. 560), and foundation piles 565 (e.g. helical piles).

Figure 6:
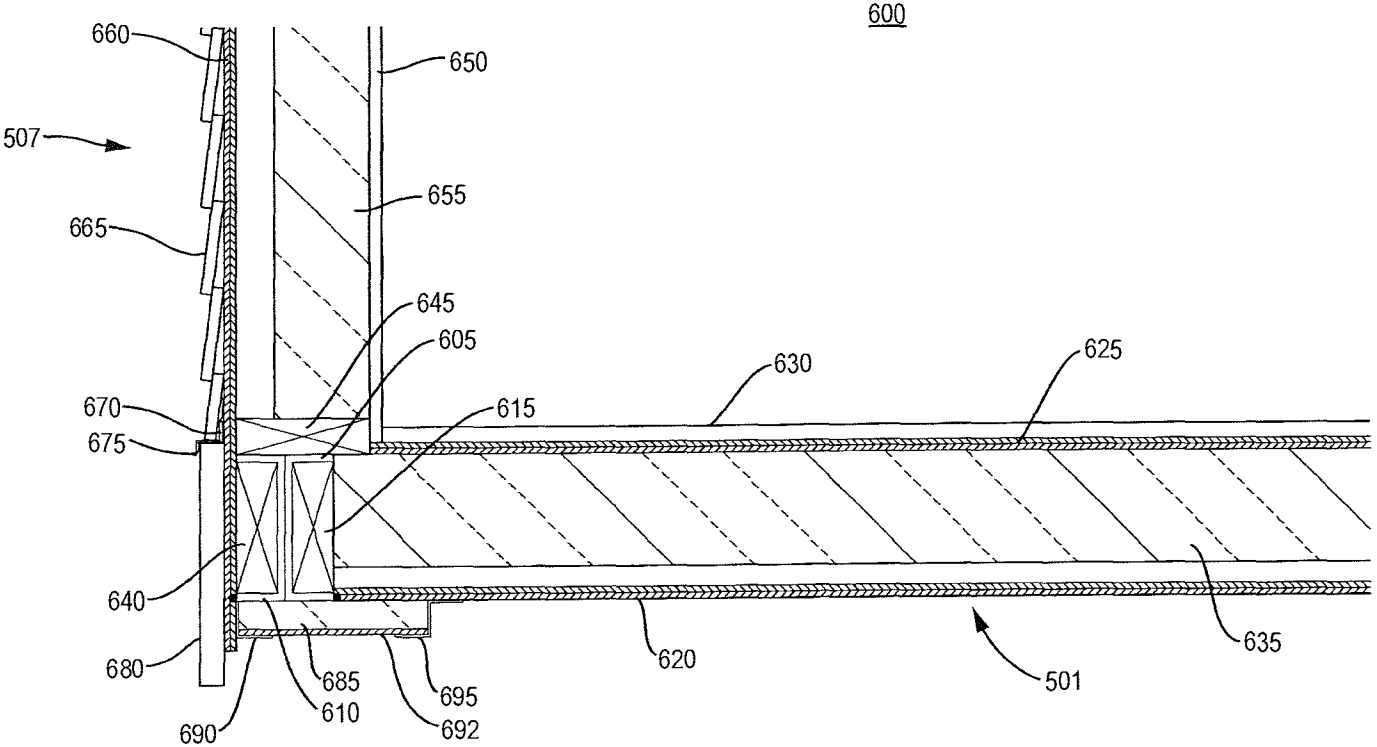
FIG. 6 is a schematic view of an exemplary double c-channel floor to wall insulated connection assembly.

FIG. 6 is a schematic view of an exemplary double c-channel floor to wall insulated connection assembly 600 of floor panel 501 and rear wall panel 507 forming an exterior edge in the building envelope. Steel c-channel 605, a structural load carrying member of frame element 405 (which is part of panel 501), and steel c-channel 610, a structural load carrying member of frame element 425 (which is part of panel 507) are affixed lengthwise (i.e., in the plane perpendicular to the drawing plane) to provide a fixed connection between floor panel 501 and rear wall panel 507. Floor panel 501 includes a blocking member 615 (e.g., a wood member) affixed lengthwise to the inside of c-channel 605, plywood 620, subfloor 625, finish floor 630, and insulation 635 (e.g., sprayfoam insulation). Rear wall panel 507 includes a blocking member 640 (e.g., a wood member) affixed lengthwise to the inside of c-channel 610, a lumber or light-gauge metal sill 645 as intermediate element, interior finishing material (e.g. painted or otherwise finished drywall) attached to intermediate elements (e.g., wood or light-gauge metal sill 645 and/or word or light-gauge metal studs of the panel (not shown)), insulation 655 (e.g., sprayfoam insulation), and plywood 660. Further shown are siding 665, flashing 670 (e.g., tape flashing), flashing 675 (e.g., Z-flashing), trim board 680, rigid insulation 685, metal angle 690, plywood 692, and metal z-angle 695. The dimensions of the c-channels can be selected based on structural load (e.g. vertical and lateral load) calculations as known in the art. The positioning of the c-channels allows direct attachment of plywood 660 to blocking member 640 in the edge (or substantially in the edge) of the building envelope which allows for the easy attachment of finish material either in product or on-site, as well as easy access for fastening of the c-channels to each other prior to finishing of the edge. The positioning of the c-channels further allows to insulate the c-channels to reduce transfer of heat between the interior and exterior of the foldable building unit.

Figure 7:
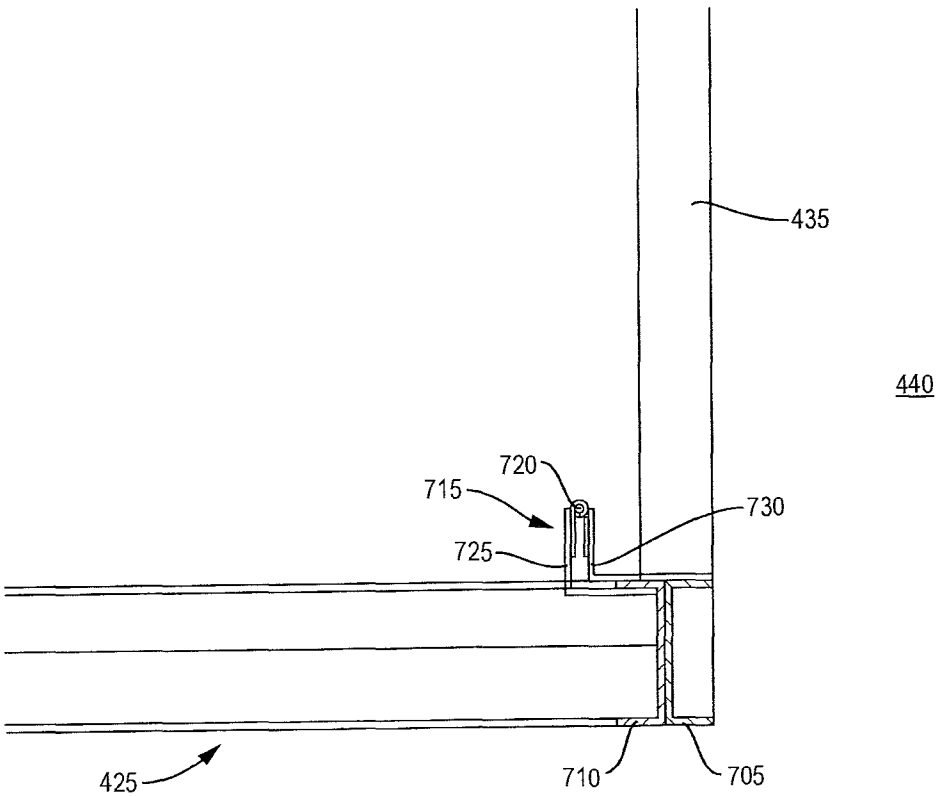
FIG. 7 is a schematic view illustrating an exemplary connection assembly hingedly connecting a floor frame element with a side wall frame element.

FIG. 7 shows an exemplary connection assembly 440 hingedly connecting floor frame element 425 with front wall frame element 435. Steel c-channel 705, which is a structural load carrying member forming part of frame element 435, and steel c-channel 710, which is a structural load carrying member forming part of frame element 425, are hingedly connected with a particular L-shaped hinge 715 of the present invention. The L-shaped hinge has a hinge pin 720 and two L-shaped hinge leaves 725 and 730 (designed to be able to nest into each other). Hinge leaf 725 is affixed to c-channel 710 and hinge leaf 730 is affixed to c-channel 705. This foldable connection allows the steel structural frame to be folded into a folded position, typically, for transport from the prefabrication site to the building site. At the building site, after unfolding, the c-channels 710 and 705 can easily be accessed and affixed. Having a c-channel such as 705 face the outside of the building has the advantage that the c-channels can be easily affixed to each other, for example, with self-drilling fasteners, and it further allows secure attachment of a blocking member lengthwise in the c-channel such that exterior finishing material can be easily attached in the edges of the building envelope.

Figure 8:
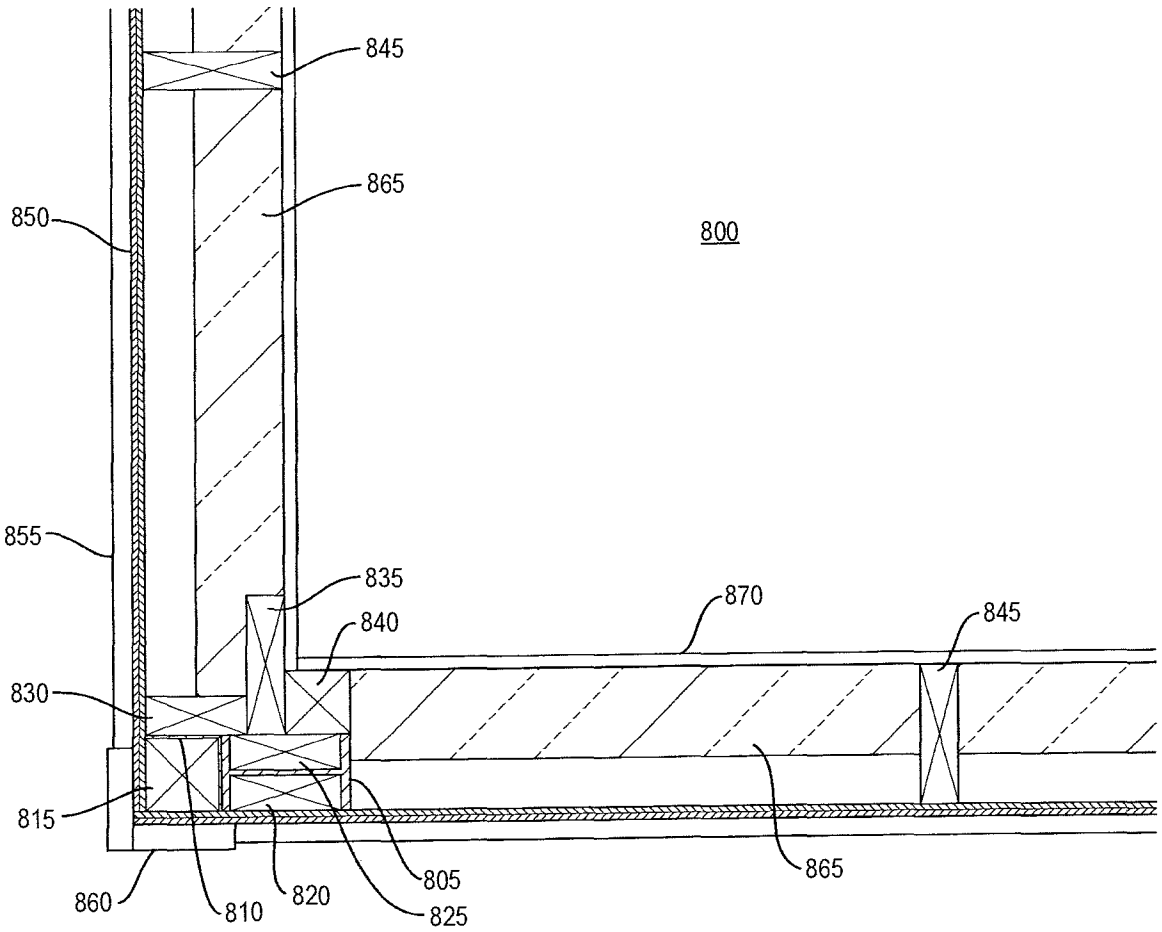
FIG. 8 is a schematic view of an exemplary fixed wall panel to wall panel connection assembly.

FIG. 8 is a schematic view of an exemplary fixed wall panel to wall panel connection assembly 800 of the present invention. Steel I-beam 805 and steel angle beam 810 are affixed lengthwise (i.e., in the plane perpendicular to the drawing plane) to provide a fixed connection between the two wall panels. Both, I-beam 805 and angle beam 810 have blocking members 815, 820 and 825 affixed lengthwise to their inside surfaces allowing for insulation and easy attachment of finishing material. The figure further shows intermediate elements (830, 835, 840 and 845 (typically, wood or light-gauge metal studs)), sheathing 850 (e.g., zip-system sheathing), siding 855 (e.g., board siding), trim board 860, insulation 865 (e.g., sprayfoam insulation), and interior finishing 870. The dimensions of the I-beam and angle beam can be selected based on structural load (e.g. vertical and lateral load) calculations as known in the art. The positioning of the angle- and I-beam allows direct attachment of sheathing 850 to blocking members 815 and 820 in the edge of the building envelope, as well as easy access for fastening of the angle beam 810 to I-beam 805 prior to finishing of the edge. The positioning of the angle- and I-beam further allows to insulate the angle- and I-beam to reduce transfer of heat between the interior and exterior of the foldable building unit.

Figure 9:
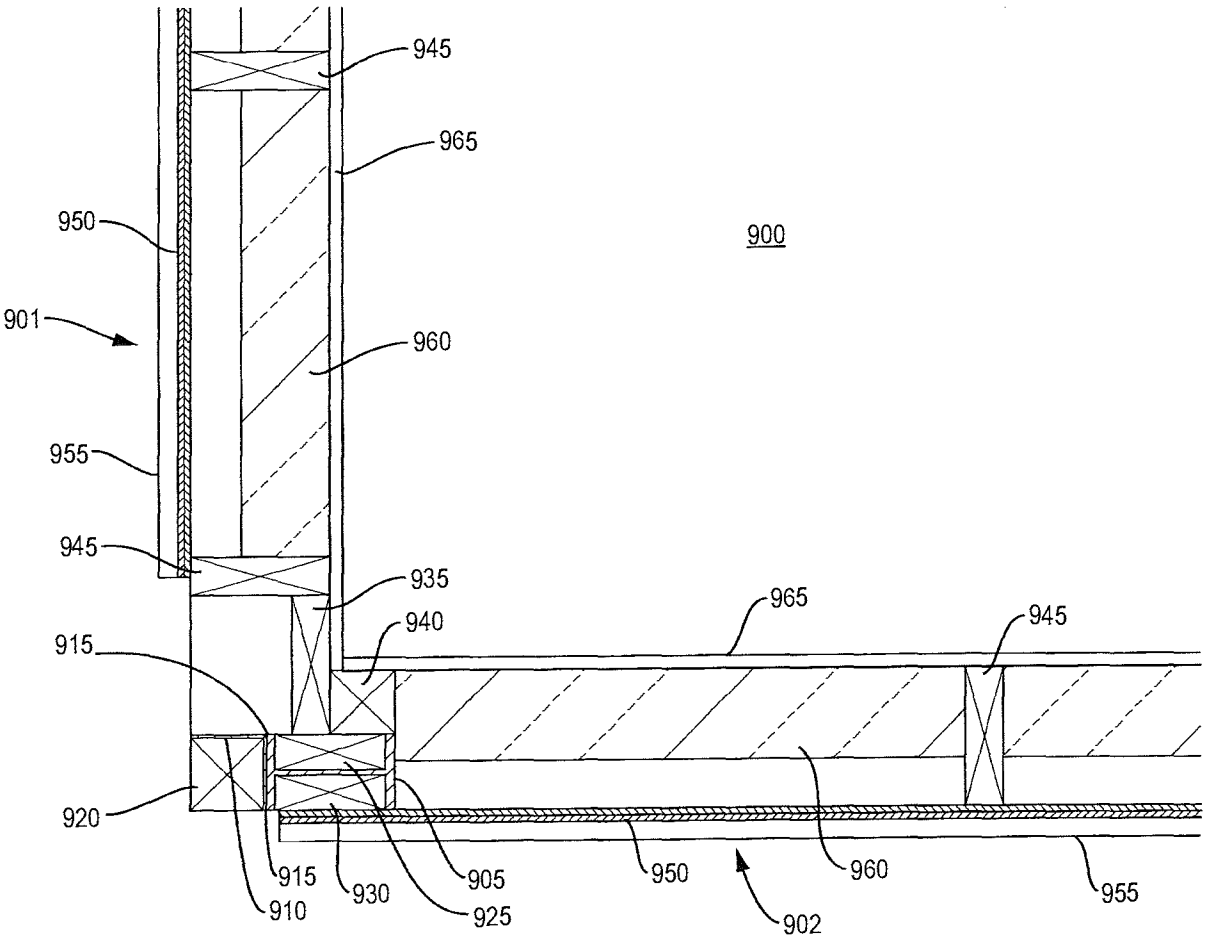
FIG. 9 is a schematic view of an exemplary folding wall panel to wall panel connection assembly in unfolded configuration and prior to finishing.

FIG. 9 is a schematic view of an exemplary folding wall panel (side wall panel 901) to wall panel (flip wall panel 902) connection assembly 900 of the present invention in unfolded configuration and prior to finishing. Steel I-beam 905 and steel angle beam 910 are affixed lengthwise (i.e., in the plane perpendicular to the drawing plane) at the building site, for example, by welding or bolting along seams 915 to establish a fixed connection between the two wall panels. Both, I-beam 905 and angle beam 910 have blocking members 920, 925 and 930 affixed lengthwise to their inside surfaces allowing for insulation and easy attachment of finishing material. The figure further shows intermediate elements (935, 940, and 945 (typically, wood or light-gauge metal studs or blocking)), sheathing 950 (e.g. zip-system sheathing), siding 955 (e.g. board siding), insulation 960 (e.g., sprayfoam insulation), and interior finishing 965. The dimensions of the I-beam and angle beam can be selected based on structural load (e.g. vertical and lateral load) calculations as known in the art. The positioning of the angle- and I-beam allows direct attachment of zip-system sheathing 950 to blocking members 920 and 930 in the edge of the building envelope, as well as easy access for fastening (e.g. welding) of the angle beam 910 to I-beam 905 prior to finishing of the edge. The positioning of the angle- and I-beam further allows to insulate the angle- and I-beam to reduce transfer of heat between the interior and exterior of the foldable building unit.

Figure 10:
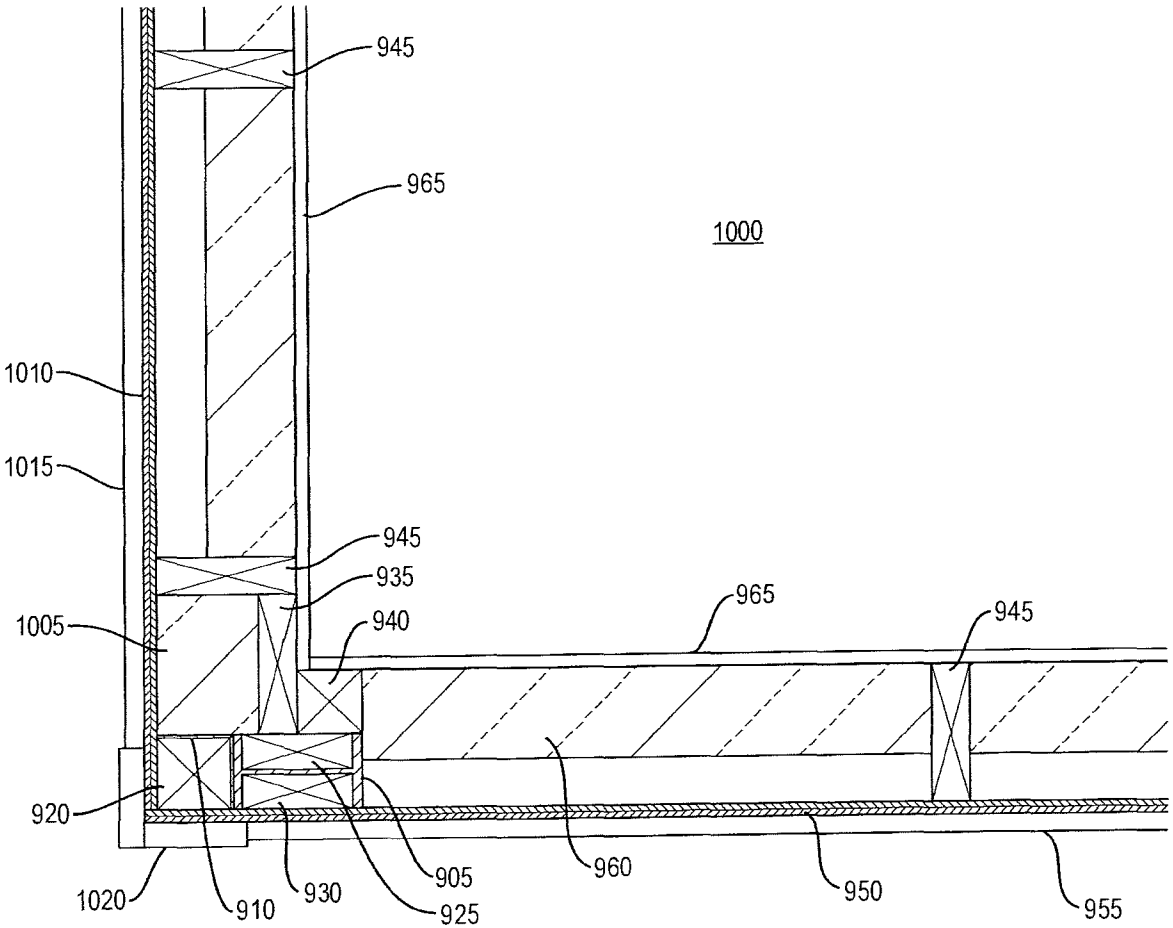
FIG. 10 is a schematic view of the connection assembly of FIG. 9 after finishing.

FIG. 10 is a schematic view of a folding wall panel (side wall panel 901) to wall panel (flip wall panel 902) connection assembly 1000 after finishing. Steel I-beam 905 and steel angle beam 910 are affixed lengthwise (i.e., in the plane perpendicular to the drawing plane), for example, by welding or mechanical fastening. The cavity formed by members 935, 945, angle beam 910 and part of blocking member 925 is filled with rigid foam insulation 1005. Further sheathing 1010 (e.g., zip-system sheathing) is attached to blocking members 920 and 930, and additional siding 1015 (e.g., board siding) and trim board 1020 attached.

Figure 11:
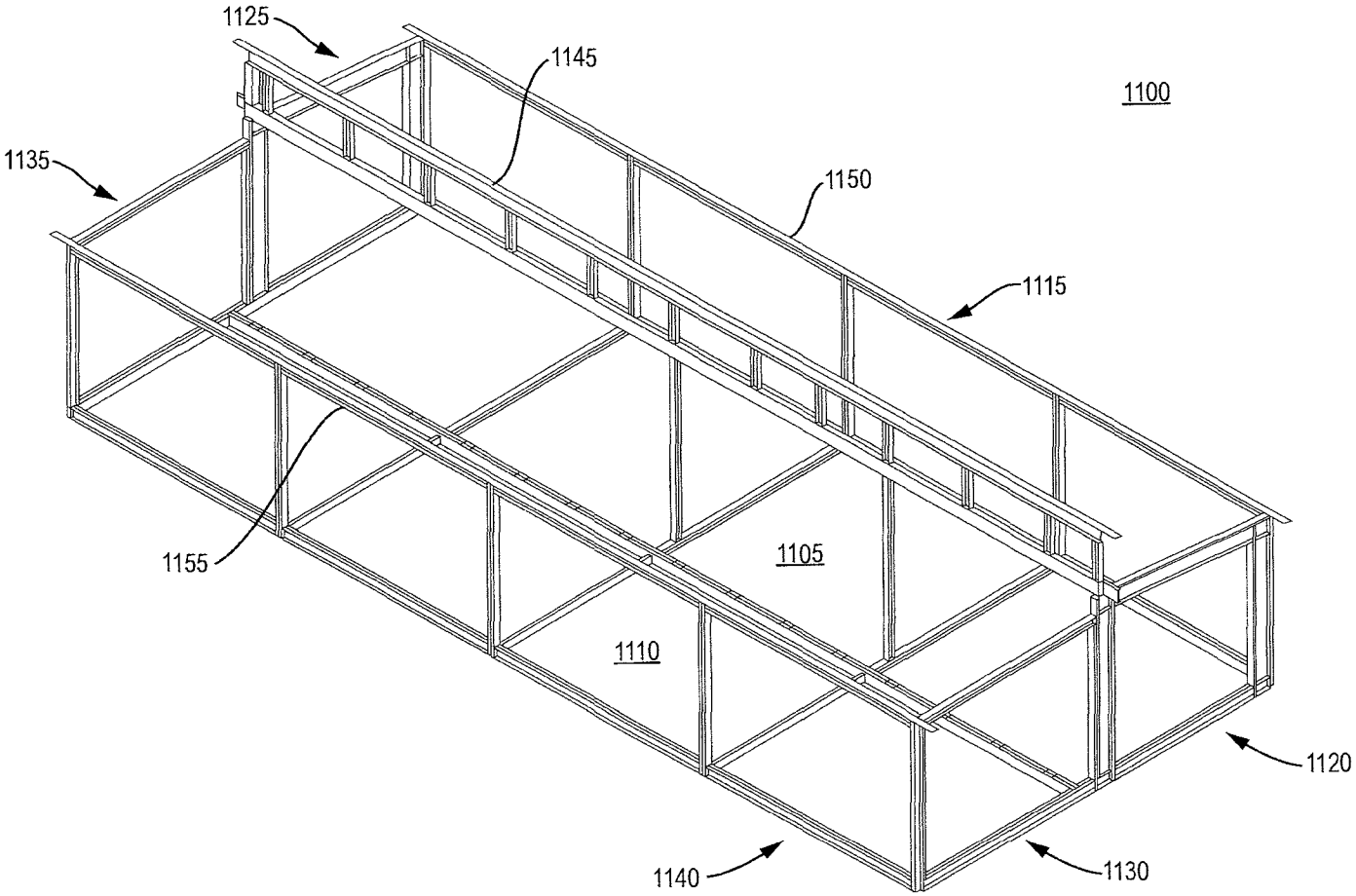
FIG. 11 is a schematic axonometric view of an exemplary foldable structural steel frame of the present invention.
Figures 12A, 12B, 12C, 12D, 12E, 12F, 12G, 12H:
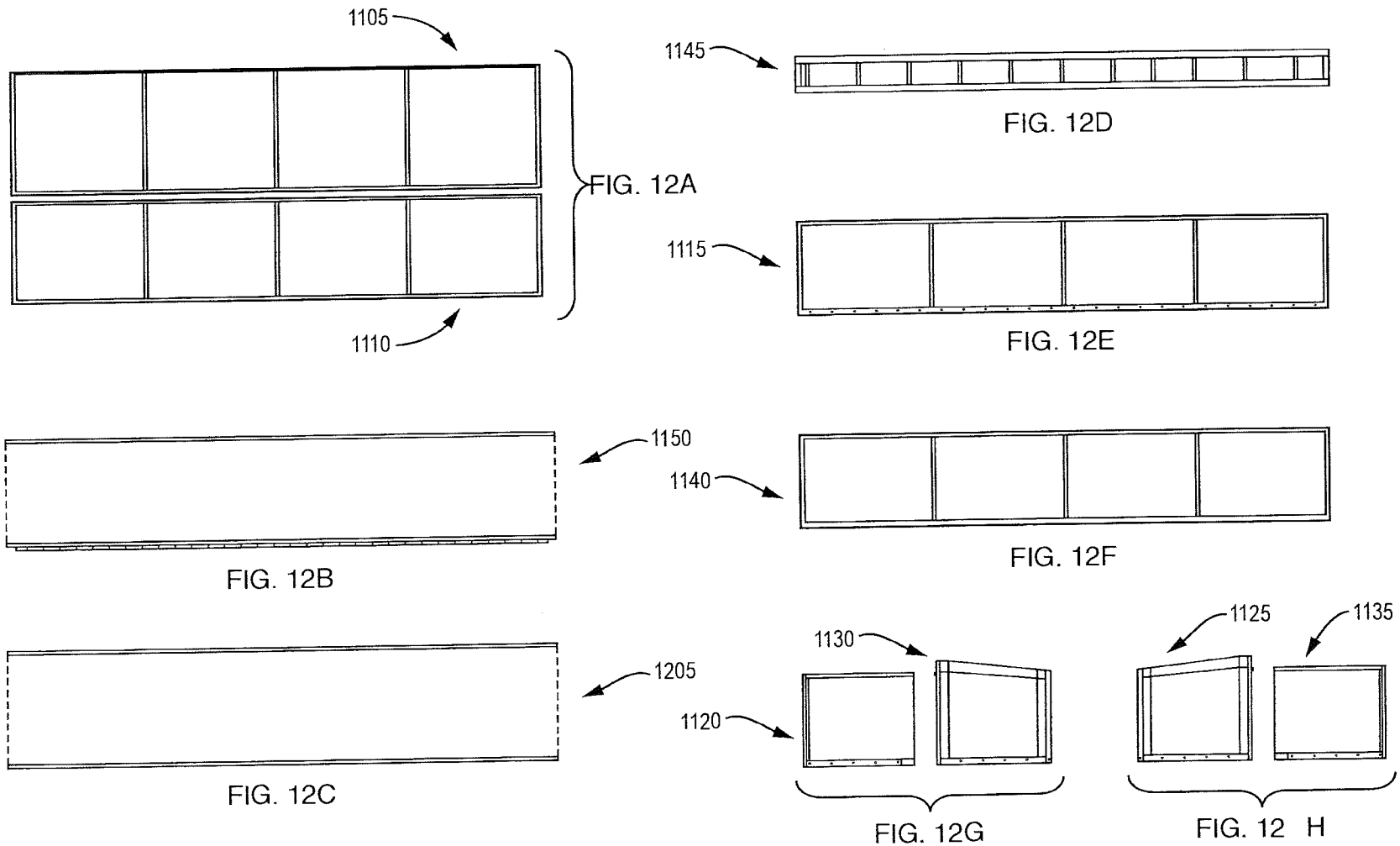
FIGS. 12A-12H are schematic views of the steel frame elements of the structural steel frame of FIG. 11

FIG. 11 is a schematic axonometric view of an exemplary foldable structural steel frame 1100 of the present invention (hinges are not shown). The structural frame includes ten steel frame elements. Fixed floor frame element 1105, folding floor frame element 1110, fixed back wall frame 1115, fixed side wall frame element 1120, fixed side wall frame element 1125, folding side wall frame element 1130, folding side wall frame element 1135, flip wall frame element 1140, clerestory frame element 1145, and fixed roof frame element 1150. The structural frame is further designed (adapted) for attaching a panelized removable roof frame element 1205 (see FIG. 12C) in position 1155.

FIGS. 12A-12H are schematic views of the steel frame elements of the structural steel frame 1100.

Figure 13:
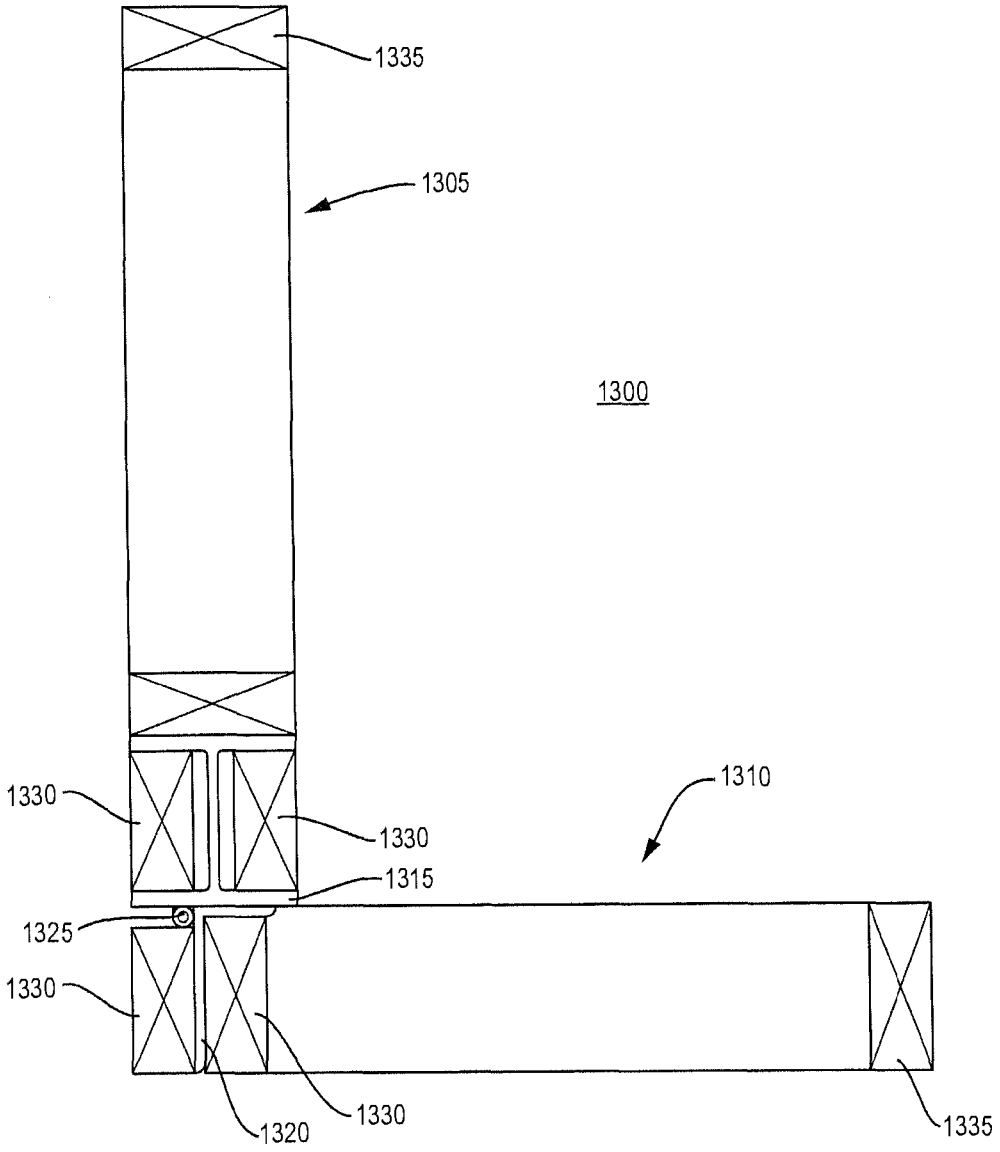
FIG. 13 is a schematic view of an exemplary folding wall panel to wall panel connection assembly.

FIG. 13 is a schematic view of an exemplary folding wall panel (1305) to wall panel (1310) connection assembly. Metal I-beam 1315 and metal angle beam 1320 are foldable connected with a hinge 1325, and are adapted to be affixed lengthwise (i.e., in the plane perpendicular to the drawing plane), after unfolding to provide a fixed connection between the panels. Blocking members 1330 are attached two the structural load carrying members 1320 and 1315 allowing attachment of exterior and interior finishing material through the exterior and interior edge of the building envelope. Further, intermediate members (typically, wood or light-gauge metal members) 1335 are shown. This connection assembly provides a foldable connection between two wall frame elements while providing an exterior and interior edge in the building envelope that substantially only exhibits blocking members (typically, wood) that allow conventional attachment of finishing material.

Figure 14:
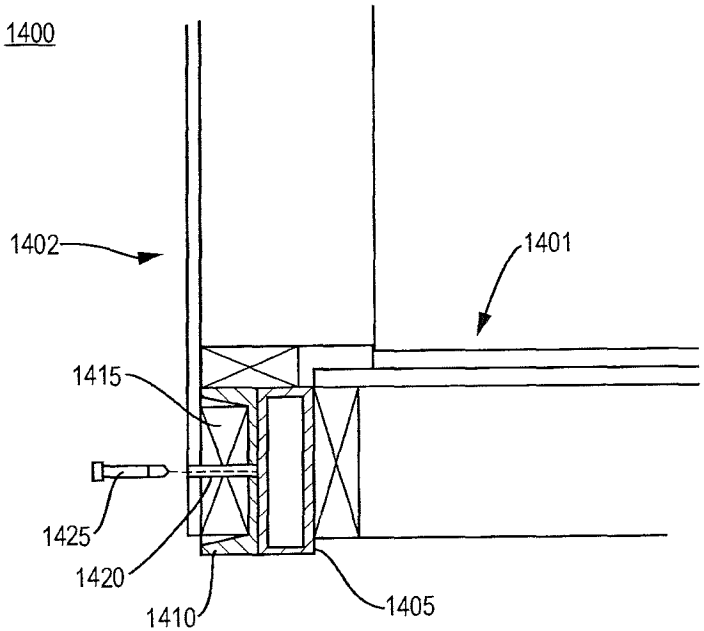
FIG. 14 is a schematic view of an exemplary fixed floor panel to wall panel connection assembly prior to finishing.
Figure 15:
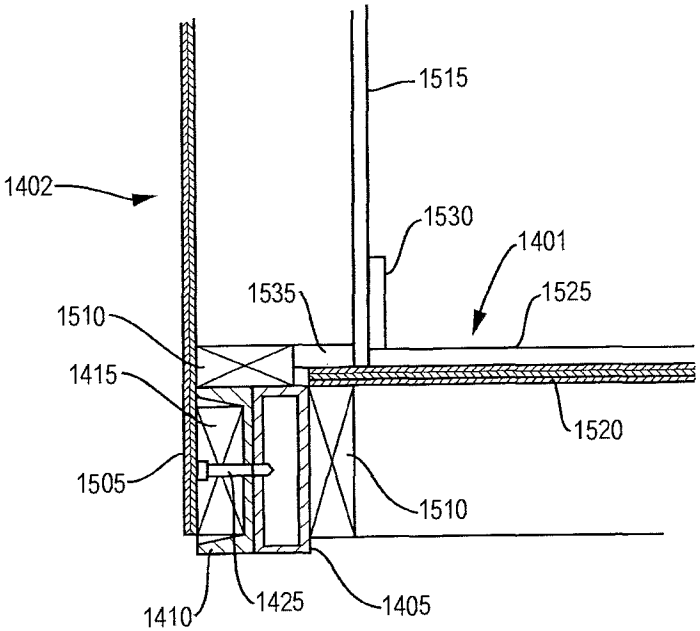
FIG. 15 is a schematic view of the connection assembly of FIG. 14 after finishing.

FIG. 14 is a schematic view of an exemplary fixed floor panel (1401) to wall panel (1402) connection assembly 1400 of the present invention prior to finishing. Fixed floor panel 1401 is based on fixed floor frame element 1105 and wall panel 1402 is based on fixed back wall frame element 1115. Hollow structural steel section 1405 and c-channel 1410 are adapted to be affixed lengthwise (i.e., in the plane perpendicular to the drawing plane) to provide a fixed connection between the panels. Typically, as is the case here, the two structural load carrying members have similar sizes for the sides that are being affixed to each other. The c-channel 1410 has a blocking member 1415 affixed lengthwise to its inside surface allowing for insulation and easy attachment of finishing material. Use of a predrilled clearance hole 1420 facilitates easy fastening of c-channel 1410 with hollow structural steel section 1405 with self drilling fasteners 1425. The dimensions of the hollow structural steel section and the c-channel can be selected based on structural load (e.g. point and lateral load) calculations as known in the art. Positioning of the c-channel 1410 such that the interior blocking member 1415 faces the outside and is close to the edge of the building envelope facilitates fastening of the c-channel and hollow structural section and further allows for easy attachment of finishing material as shown in FIG. 15. The connection assembly further allows for the steel frame elements to be framed in by conventional wood lumber with a traditional finish on the outside. This connection detail further allows panels to be prefabricated including finishing in the factory and assembled at the building site with little work, for example, because of connection between the structural load carrying members with self-tapping screws or pre-drilled holes.

FIG. 15 is a schematic view of connection assembly 1400 after finishing. Hollow structural steel section 1405 and c-channel 1410 are affixed lengthwise to each other with self-drilling fastener 1425. Additional sheathing 1505 is directly attached to blocking member 1415. The figure further shows intermediate members 1510, interior wall finishing material 1515 (e.g. painted or otherwise finished drywall), subfloor 1520, finish floor 1525, baseboard 1530, and intermediate member 1535.

Figure 16:
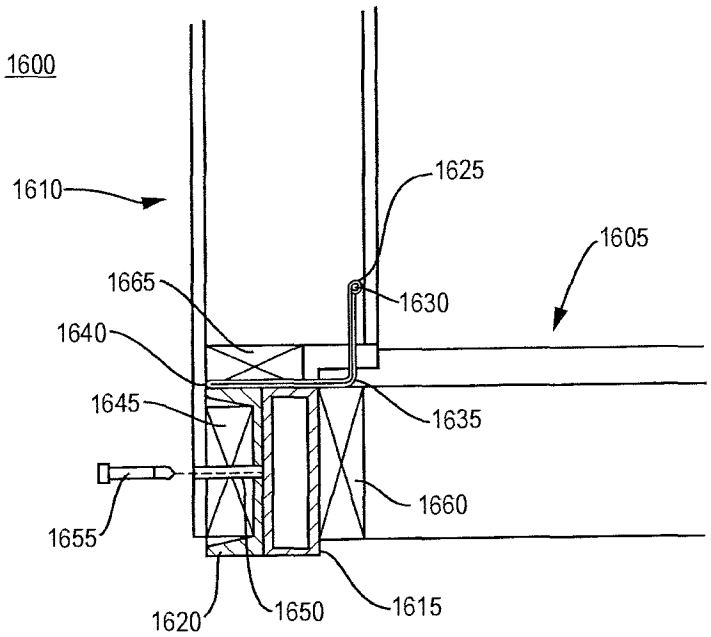
FIG. 16 is a schematic view of an exemplary folding floor panel to folding wall panel connection assembly in unfolded configuration and prior to finishing.
Figure 17:
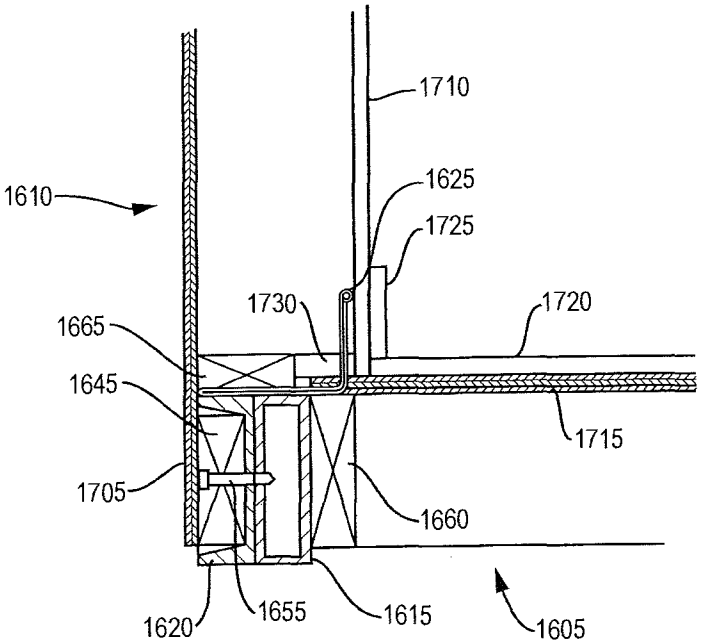
FIG. 17 is a schematic view of the connection assembly of FIG. 16 after finishing.

FIG. 16 is a schematic view of an exemplary folding floor panel (1605) to folding wall panel (1610) connection assembly 1600 of the present invention after unfolding and prior to finishing. Folding floor panel 1605 is based on folding floor frame element 1110 and folding wall panel 1610 is based on folding wall frame element 1140. Hollow structural steel section 1615 and c-channel 1620 are adapted to be affixed lengthwise (i.e., in the plane perpendicular to the drawing plane) to provide a fixed connection between the panels in unfolded configuration. Typically, as is the case here, the two structural load carrying members have similar sizes for the sides that are to be affixed to each other. Steel c-channel 1620, which is a structural load carrying member forming part of frame element 1140, and hollow structural steel section 1615, which is a structural load carrying member forming part of frame element 1110, are hingedly connected with a particular L-shaped hinge 1625 of the present invention, which is positioned to remain in the finished foldable building unit. The L-shaped hinge has a hinge pin 1630 and two L-shaped hinge leaves 1635 and 1640. Hinge leaf 1640 is affixed (e.g. bolted or welded) to c-channel 1620 and hinge leaf 1635 is affixed to hollow structural steel section 1615. This foldable connection allows panels to be folded into a folded position, typically, for transport from the prefabrication site to the building site. At the building site, after unfolding, the c-channel 1620 and hollow structural steel section 1615 can easily be accessed and affixed to each other. Having a c-channel such as 1620 face the outside of the foldable building unit has the advantage that the c-channel can be easily affixed to the hollow structural steel section, for example, with self-drilling fasteners, and it further allows secure attachment of a blocking member lengthwise in the c-channel such that exterior finishing material can be easily attached in the edges of the building envelope. The c-channel 1620 has a blocking member 1645 affixed lengthwise to its inside surface allowing for insulation and easy attachment of finishing material. The figure further shows intermediate members 1660 and 1665. Use of a predrilled clearance hole 1650 facilitates easy fastening of c-channel 1620 with hollow structural steel section 1615 with a self drilling fastener 1655. The dimensions of the hollow structural steel section and the c-channel can be selected based on structural load (e.g. point and lateral load) calculations as known in the art. Positioning of the c-channel 1620 such that the interior blocking member 1645 faces the outside and is close to the edge of the building envelope facilitates fastening of the c-channel and hollow structural section and further allows for easy attachment of finishing material as shown in FIG. 17. The L-shaped hinge 1625 is positioned within the wall assembly thereby allowing for the wall finishes to be installed in the factory, and reducing work at the building site. The hinge is further offset to allow for the connected panels to be folded into parallel position with a specified gap for shipping, thereby preventing or, at least, substantially reducing damage to finishing material.

FIG. 17 is a schematic view of connection assembly 1600 after finishing. Hollow structural steel section 1615 and c-channel 1620 are affixed lengthwise to each other, for example, with self-drilling fastener 1655. Additional sheathing 1705 is directly attached to blocking member 1645. The figure further shows interior wall finishing material 1710 (e.g. painted or otherwise finished drywall), subfloor 1715, finish floor 1720, baseboard 1725, and intermediate member 1730.

Figure 18:
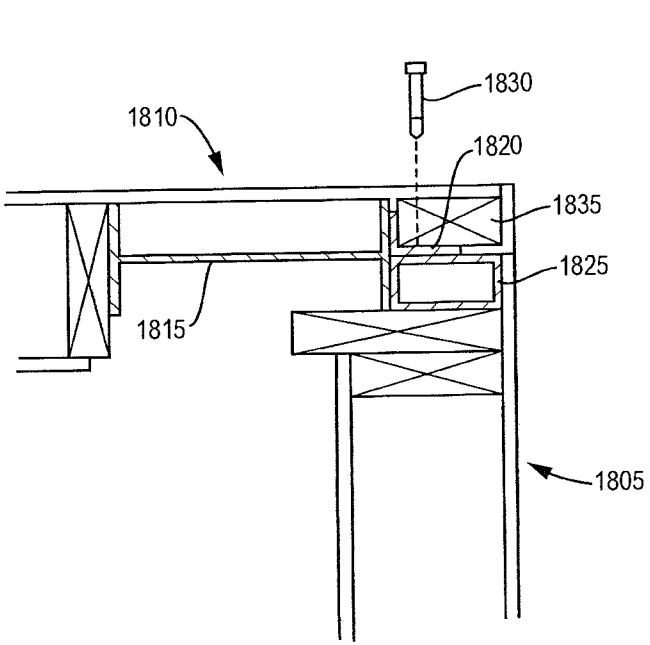
FIG. 18 is a schematic view of an exemplary fixed back wall panel to side wall panel connection assembly prior to finishing.

FIG. 18 is a schematic view of an exemplary fixed back wall panel (1805) to side wall panel (1810) connection assembly 1800 of the present invention prior to finishing. Fixed back wall panel 1805 is based on fixed back wall frame element 1115 and side wall panel 1810 is based on fixed side wall frame element 1125. The connection assembly includes three structural load carrying members 1815, 1820 and 1825 adapted and positioned to be affixed lengthwise to each other to provide a fixed connection between the panels. Steel angle beam 1820 is affixed to steel I-beam 1815 and positioned such that the steel angle beam 1820 can be affixed to the hollow structural steel section 1825, for example, with a self-drilling fastener 1830. The angle beam 1820 has a blocking member 1835 affixed lengthwise to its inside surface allowing for insulation and easy attachment of finishing material. The dimensions of the structural load carrying members can be selected based on structural load (e.g. point and lateral load) calculations as known in the art. The connection assembly 1800 allows for continuous carpentry finish at the connection/corner seam of the panels. It also reduces the extent of work at the building site because a small number of seams must be finished. Further, intermediate members (e.g. wood or light-gauge metal studs), for example, 1915 and 1835 can be positioned to enable a continuous structural grid (e.g., a conventional 16 inch grid) through the corner of the foldable building unit.

Figure 19:
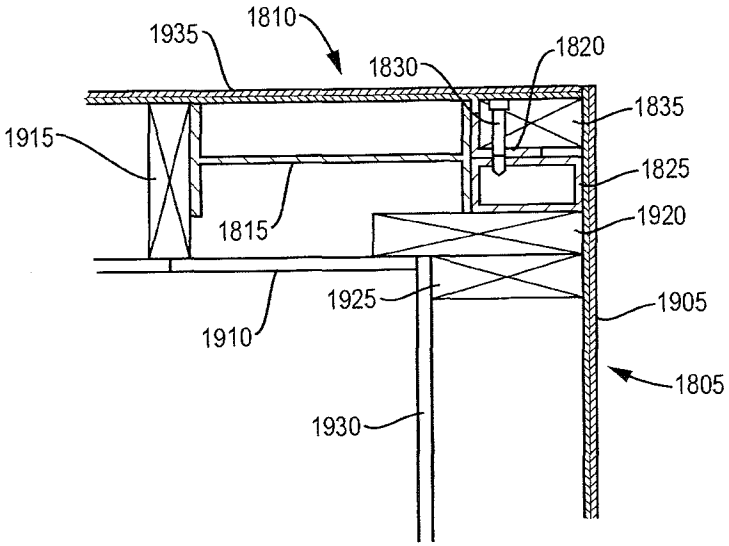
FIG. 19 is a schematic view of the connection assembly of FIG. 18 after finishing.

FIG. 19 is a schematic view of connection assembly 1800 after finishing. Hollow structural steel section 1825 and angle beam 1820 are affixed lengthwise to each other with self-drilling fastener 1830. Additional sheathing 1905 is directly attached to blocking member 1835. Further, additional interior finishing material (e.g. drywall) is attached to intermediate members 1915 and 1920. The figure further shows intermediate member 1925, interior wall finishing material 1930 (e.g. drywall, painted or otherwise finished), and exterior sheathing 1935.

The foldable building units of the present invention can be prefabricated such that the foldable buildings, after unfolding on the building site, are substantially in finished condition. That is, they do not require or significantly reduce the addition of further building sections such as wall panels, floor and roof sections, or the addition of interior and exterior finish materials with the exception of minor, non-structural finishing in areas required for folding movement. Further, foldable building units of the present invention can include roof sections that are panelized but can be easily installed at the building site. The prefabrication process can be reduced substantially, even to the extent that merely a foldable structural frame of the present invention is prefabricated and unfolded at the building site.

Further, all necessary mechanical and electrical systems for the residential or commercial foldable building, for example, all the required appliances and plumbing fixtures, can be installed in a core structure (i.e., a part of the structural frame of the foldable building that is made of frame elements that are not unfolded at the building site). Flexible piping and wiring can also be chased throughout both fixed and foldably connected panels of the foldable building units of the present invention.

Use of structural steel in the form of appropriately dimensioned I-beams, c-channels, wide-flange beams, and hollow structural sections allows for large frame geometries as part of the structural frame of the foldable building unit, for example, rectangular frame elements spanning the entire side of a foldable building, reducing prefabrication cost and/or simplifying unfolding at the building site.

Further, foldable structural frames substantially made of metal frame elements (e.g., made from hot-formed steel such as I-beams, c-channels, wide-flange beams, and hollow structural sections) can be prefabricated to superior tolerances such that a respective foldable building unit in substantially finished condition upon unfolding exhibits reduced or no gaps in the seam areas between foldably connected frame elements thereby reducing the work associated with on-site finishing of these seam areas.

Foldable building units, for example, the foldable buildings shown in FIG. 1 can further include a number of prefabricated interior walls (not shown) that can be fixed, foldably connected, or panelized and form one or more rooms in the unfolded building.

The foldable building units of the present invention can be several stories high. For example, multi-story structures can be built on-site by stacking separate foldable building units with a crane. In this arrangement, ceiling frame elements of the lower unfolded foldable building unit lie directly below floor frame elements of the upper foldable building unit. During prefabrication, appropriate openings can be included in the ceiling of the lower foldable building unit and in the floor of the upper foldable structure to accommodate a staircase, which can be installed in the lower foldable building unit during prefabrication.

Steel frame elements of the present invention are typically combined with wooden or light-gauge metal intermediate elements to form lightweight steel and wood/light-gauge metal hybrid structures in which the frame elements provide structural stability and the wooden or light-gauge metal intermediate elements provide substantial lateral structural resistance and/or are used to attach interior and exterior finishing material using standard construction approaches, reducing labor training and associated costs.

In certain embodiments of the present invention, structural load carrying members connecting different frame elements of the structural frame allow blocking material (e.g. wood or light-gauge metal studs) to be connected to inside areas of the structural load carrying members, and the structural load carrying members are positioned such that the blocking members face the outside of the foldable building unit. This allows structural frames that have a continuous conventional structural grid (e.g., 16 inch wood lumber grid) through the edges/corners of the foldable building unit, thereby allowing attachment of exterior finishing material through the edges/corners using standard construction approaches, reducing labor training and associated costs, and work at the building site.

Use of these strong and lightweight structures can also substantially reduce the amount of required building material and the weight of the frame elements, which in turn facilitates the transport of larger folded building units for a given maximal allowed weight according to given road regulations.

Indirect connections of interior and/or exterior finishing materials to metal frame elements (particularly, frame elements made of structural steel sections) are one aspect of a "multi-tolerance" building approach that disaggregates and cushions brittle or otherwise fragile finish materials from the vibrational, kinetic and settling forces applied to the structural frame during shipping, setting, unfolding and settling of the prefabricated foldable building units. A second aspect of a multi-tolerance building approach is provided by the offset hinges (in particular, L-shaped offset hinges) of the present invention which are specifically engineered to safely nest hingedly (i.e., foldably connected with one or more hinges) connected frame elements at a designed distance away from its neighboring frame element, allowing, for example, for thicker wall depths and thus the prefabricated inclusion of finish materials. This is associated with a significant reduction in the scope of work to be completed on-site, where costs and scheduling are far less manageable. Thus, foldable building units of the present invention can include final interior finishing, such as trim, gypsum board, paint or wallpaper.

Structural load carrying members of the present invention can be foldably connected with hinges to foldably connect frame elements and respective panels. More typically, structural load carrying members of the present invention can be foldably connected with offset hinges, and preferably, L-shaped offset hinges (such as those shown in FIGS. 7 and 16) adapted and positioned to remain within the building envelope. In completely folded configuration of foldably connected panels, L-shaped offset hinges provide an offset, which allows sufficient clearance for finish and other materials. Further, the interior finish materials attached to the frame elements can be sufficiently offset from each other to avoid direct and potentially damaging contact, for example, during transport.

Foldable building units if the present invention can provide part of a building (commercial or residential) or can be an entire foldable building (commercial or residential) when unfolded.

A foldable building unit in "unfolded configuration" is a foldable building unit in which the foldably connected frame elements have been unfolded into positions that can be maintained in the finished condition of the foldable building unit. A foldable building unit in "folded configuration" is a foldable building unit in which foldably connected frame elements are folded into positions suitable for uploading, transport, and/or unloading of the building unit.

A "structural frame" as used herein, refers to the totality of structural load carrying members of a foldable building unit that are primarily responsible for providing structural stability of the foldable building unit in folded, partially unfolded and unfolded configuration, and which transmit loads (e.g., static, dynamic, and/or vibrational loads) to the ground. Structural frames can include members that are made of a plurality of materials in various forms and dimensions. Suitable materials that can be used include but are not limited to metal (e.g., aluminum or steel), wood and polymers. Suitable structural load carrying members include but are not limited to hollow structural sections, C-channels (with or without return), I-beams (including S and W type), T-beams, angle beams, and wide-flange beams. Preferably, the structural load carrying members are commercially available American standard structural load carrying members. Typically, two connected structural load carrying members are not both hollow structural steel sections. The selection of a material, form and dimension for a given structural part or member of a structural frame is interdependent and depends on factors such as the position of the structural part or member in the structural frame, and whether the member is part of a frame element that is foldably connected.

In the context of the shape of structural load carrying member, "inside", "inside area", "interior area", "inside surface" or "interior surface" refers to the areas of the structural load carrying member that are inside of a box enveloping the structural load carrying member. That is, if a cross-sectional view of the structural load carrying member is considered (as shown, e.g., in FIGS. 6 to 10, and 14 to 19), any part of the perimeter of the structural load carrying member that is inside of a rectangle enveloping (i.e., with minimum perimeter length of the rectangle) the structural load carrying member corresponds to the "inside", an "inside area", an "interior area", an "inside surface" or an "interior surface."

A "frame element" as used herein, refers to an element of a structural frame of a foldable building unit that includes a plurality of structural load carrying members that form a closed or open frame. Typically, the members form a closed frame. However, the members can also form an open frame, or have additional members. Some typical frame elements are shown in FIGS. 12A-12H. Structural load carrying metal members can be fixedly connected as known in the art, for example, by welding, bolting or with self-drilling fasteners to form a metal frame element.

Interior and exterior finish materials can be attached to the structural frame, typically, by attachment with intermediate elements affixed to frame elements of the structural frame. Interior and exterior finishing materials are typically attached (e.g., glued, nailed, screwed, welded and/or bolted, or otherwise affixed) to intermediate elements. Interior finish materials include but are not limited to wall finishing (for example, gypsum board and sheathing), ceiling finishing and floor finishing (for example, sheathing with Bamboo flooring on top). Exterior finishing elements include but are not limited to siding and roofing.

For finish materials, and, in particular, interior finish materials, it has been found that "indirect connection" to the frame elements to reduce contact, partially or entirely, of the interior finish materials with the frame elements is advantageous for one or more of the following reasons. Reduced contact can (a) reduce the transfer of structural stresses from one or more frame elements of the structural frame to the often fragile and brittle interior finish materials thereby reducing or eliminating significant damage (such as dry wall cracking) of the interior finish materials, in particular, during folding, uploading, transporting, unloading and/or unfolding of the foldable building unit, and settling, (b) reduce or eliminate the exposure of the interior finish materials to water, for example, water that can condensate on metal parts of the frame elements, and (c) reduce heat transfer between the inside of the finished building unit to the outside of the finished building unit.

Thus, generally, it is preferred to use indirect rather than direct connections of finish materials, particularly, interior finish materials with respective frame elements. However, even though indirect connections are typically preferred, not all connections between interior finish material and a respective frame element have to be indirect.

Typically, intermediate elements are made, at least in part, of materials that have a force cushioning effect, that is, force cushioning elements such as, for example, wood, sprayed foam, and light-gauge metal studs. Typically, an intermediate element is positioned and dimensioned such that it can connect or can be connected (e.g., using powder-actuated fasteners or self-tapping screws) to the frame element through one area of the intermediate element (e.g., through one side of the intermediate element) and that it can be connected to the finish material, particularly, the interior finish material (for example, using nails or screws) through another area of the intermediate element (e.g., through another side of the intermediate element). Even more preferably, intermediate elements are entirely made of force cushioning materials such as wood.

Foldable building units of the present invention typically include wall panels, roof and floor sections that are in substantially finished condition, that is, with the exception of unfinished areas dimensioned to accommodate folding of the frame elements, and unfinished areas due to wall connection seams (i.e., seams between walls that are not connected but upon unfolding jointly form a wall), these wall panels, roof and floor panels are finished.

"Finished panels" as referred to herein, are panels that include frame elements and interior finish materials connected (typically, indirectly) to them, and can also include elements such as doors and windows.

The foldable building units of the present invention are foldable to facilitate transport of the pre-fabricated building units. Preferably, the foldable building units in folded configuration are dimensioned such that transport with a transport vehicle is possible, preferably, with a semitrailer and without requiring a special transport permit. Regulations pertaining to the operation of trucks and trailers vary from country to country, and, in some instances from state to state.

While this invention has been particularly shown and described with references to example embodiments thereof, it will be understood by those skilled in the art that various changes in form and details may be made therein without departing from the scope of the invention encompassed by the appended claims.

What is claimed is:

1. A foldable building unit, comprising (a) a first frame element having a first structural load carrying member selected from the group comprising a hollow structural metal section, a metal C-channel, a metal I-beam, a metal T-beam, a metal angle beam, and a metal wide-flange beam;

(b) a second frame element having a second structural load carrying member selected from the group comprising a hollow structural metal section, a metal C-channel, a metal I-beam, a metal T-beam, and a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other; wherein the first structural load carrying member is positioned relative to the second structural load carrying member to allow direct fastening between the first structural load carrying member and the second structural load carrying member from outside the foldable building unit.

2. The foldable building unit of claim 1, wherein the foldable building unit has a structural metal frame and the first frame element, the second frame element, the first structural load carrying member and the second structural load carrying member are part of the structural metal frame.

3. The foldable building unit of claim 1, wherein the first structural load carrying member is a metal C-channel having a web and positioned relative to the second structural load carrying member to allow direct fastening through the web of the metal C-channel between the first structural load carrying member and the second structural load carrying member from outside the foldable building unit.

4. The foldable building unit of claim 1, wherein the first structural load carrying member is selected from the group comprising a metal C-channel and a metal I-beam, with a blocking member affixed lengthwise to an interior surface of the first structural load carrying member, and the first structural load carrying member is oriented and positioned such that exterior finishing materials can be directly attached to the blocking member.

5. The foldable building unit of claim 1, wherein the first structural load carrying member is selected from the group comprising a metal C-channel and a metal I-beam, with a blocking member affixed lengthwise to an interior surface of the first structural load carrying member, the first structural load carrying member and the second structural load carrying member are lengthwise foldably connected such that when the first frame element and second frame element are in unfolded configuration, the first structural load carrying member is positioned relative to the second structural load carrying member to allow direct lengthwise fastening between the first structural load carrying member and the second structural load carrying member from outside the foldable building unit to form a fixed connection between the first frame element and the second frame element; and the first structural load carrying member is oriented and positioned such that exterior finishing material can be directly attached to the blocking member.

6. The foldable building unit of claim 1, wherein the foldable building unit comprises a first panel connected to a second panel to form an exterior edge of the foldable building unit, the first panel including (a-i) the first frame element, (a-ii) insulation material within the first panel, and (a-iii) one or more blocking members directly attached to the first frame element; and a second panel including (b-i) the second frame element, (b-ii) insulation material within the second panel, and (b-iii) one or more blocking members directly attached to the second frame element; and the first structural load carrying member and the second structural load carrying member being thermally insulated with the insulation material of the first and/or second panel, or with one or more blocking members of the first and/or second panel to reduce heat transfer through the exterior edge.

7. The foldable building unit claim 6, wherein the first panel and the second panel further comprise finishing material directly affixed to the blocking members.

8. The foldable building unit of claim 1, wherein the first structural load carrying member and the second structural load carrying member have substantially the same structural load carrying properties.

9. The foldable building unit of claim 1, wherein the first structural load carrying member and the second structural load carrying member have cross-sectional areas that differ by not more than a factor of ten.

10. The foldable building unit of claim 1, wherein the first structural load carrying member and the second structural load carrying member are not both metal I-beams, and have cross-sectional areas that differ by not more than a factor of three.

11. The foldable building unit of claim 1, wherein the first structural load carrying member and the second structural load carrying member are not both a metal C-channel or a metal I-beam.

12. The foldable building unit of claim 1, wherein the first structural load carrying member and the second structural load carrying member are foldably connected with a metal hinge.

13. The foldable building unit of claim 1, wherein the first structural load carrying member and the second structural load carrying member are positioned to form a part of an exterior edge of the foldable building unit, the first structural load carrying member being closer to the exterior edge than the second structural load carrying member, and the first structural load carrying member being a metal C-channel or a metal I-beam with a blocking member affixed lengthwise to an interior surface of the first structural load carrying member, and the first structural load carrying member oriented such that the blocking member is accessible from outside the foldable building unit.

14. The foldable building unit of claim 1, wherein at least three structural load carrying members form the first frame element and at least three structural load carrying members form the second frame element.

15. The foldable building unit of claim 1, wherein the a side of the first structural load carrying member substantially abuts a side of the second structural load carrying member.

16. The foldable building unit of claim 1, wherein the first frame element and the second frame element are part of the structural frame of a foldable building.

17. The foldable building unit of claim 1, wherein the foldable building unit is a residential building.

18. The foldable building unit of claim 1, wherein the foldable building unit is a building with a building envelope that is substantially entirely formed by panels that are connected through structural load carrying members that are, independently, a hollow structural metal section, a metal C-channel, a metal I-beam, a metal T-beam, a metal angle beam, or a metal wide-flange beam.

19. The foldable building unit of claim 18, wherein structural load carrying members in edges of the building envelope have blocking members attached to inside surfaces of the structural load carrying members, and exterior finishing material is attached to the blocking members.

20. The foldable building unit of claim 1, wherein the foldable building unit in unfolded configuration is in substantially finished condition.

21. The foldable building unit of claim 1, wherein the first structural load carrying member and the second structural load carrying members are affixed to each other in a manner that allows substantial structural load transfer between the first structural load carrying member and the second structural load carrying member without structural failure.

22. A foldable building unit, comprising (a) a first frame element having a first structural load carrying member selected from the group comprising a hollow structural metal section, a metal C-channel, a metal I-beam, a metal T-beam, a metal angle beam, and a metal wide-flange beam;

(b) a second frame element having a second structural load carrying member selected from the group comprising a hollow structural metal section, a metal C-channel, a metal I-beam, a metal T-beam, and a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other; wherein the first structural load carrying member and the second structural load carrying member are lengthwise foldably connected such that when the first frame element and second frame element are in unfolded configuration relative to each other, the first structural load carrying member is positioned relative to the second structural load carrying member to allow direct lengthwise fastening between the first structural load carrying member and the second structural load carrying member from outside the foldable building unit to form a fixed connection between the first frame element and the second frame element.

23. A foldable building unit, comprising (a) a first frame element having a first structural load carrying member selected from the group comprising a hollow structural metal section, a metal C-channel, a metal I-beam, a metal T-beam, a metal angle beam, and a metal wide-flange beam;

(b) a second frame element having a second structural load carrying member selected from the group comprising a hollow structural metal section, a metal C-channel, a metal I-beam, a metal T-beam, and a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other; wherein the first structural load carrying member and the second structural load carrying member are lengthwise foldably connected with an offset hinge adapted and positioned to offset a first panel including the first frame element from a second panel including the second frame element when the first frame element and the second frame element are in folded configuration to thereby position the first panel in substantially parallel position to the second panel.

24. The foldable building unit of claim 23, wherein the first structural load carrying member and the second structural load carrying member are not both a metal C-channel or a metal I-beam.

25. A foldable building unit, comprising (a) a first frame element having a first structural load carrying member selected from the group comprising a hollow structural metal section, a metal C-channel, a metal I-beam, a metal T-beam, a metal angle beam, and a metal wide-flange beam;

(b) a second frame element having a second structural load carrying member selected from the group comprising a hollow structural metal section, a metal C-channel, a metal I-beam, a metal T-beam, and a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other; wherein the foldable building unit comprises a first panel including the first frame element and a second panel including the second frame element, and the first structural load carrying member and the second structural load carrying member are lengthwise foldably connected with an offset hinge adapted and positioned to remain within the first panel and/or second panel.

26. A foldable building unit, comprising (a) a first frame element having a first structural load carrying member selected from the group comprising a hollow structural metal section, a metal C-channel, a metal I-beam, a metal T-beam, a metal angle beam, and a metal wide-flange beam;

(b) a second frame element having a second structural load carrying member selected from the group comprising a hollow structural metal section, a metal C-channel, a metal I-beam, a metal T-beam, and a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other; The foldable building unit of claim 1, wherein at least the first or the second structural load carrying member has a blocking member affixed lengthwise to an interior surface of the structural load carrying member, and the blocking member is positioned such that exterior finishing material can directly be affixed to the blocking member.

27. The foldable building unit of claim 26, wherein the first structural load carrying member is selected from the group comprising a metal C-channel and a metal I-beam, with a blocking member affixed lengthwise to an interior surface of the first structural load carrying member, and the first structural load carrying member is oriented and positioned such that exterior finishing materials can be directly attached to the blocking member.

28. The foldable building unit of claim 26, wherein the first structural load carrying member is selected from the group comprising a metal C-channel and a metal I-beam, with a blocking member affixed lengthwise to an interior surface of the first structural load carrying member, the first structural load carrying member and the second structural load carrying member are lengthwise foldably connected such that when the first frame element and second frame element are in unfolded configuration, the first structural load carrying member is positioned relative to the second structural load carrying member to allow direct lengthwise fastening between the first structural load carrying member and the second structural load carrying member from outside the foldable building unit to form a fixed connection between the first frame element and the second frame element; and the first structural load carrying member is oriented and positioned such that exterior finishing material can be directly attached to the blocking member.

29. The foldable building unit of claim 26, wherein the first structural load carrying member and the second structural load carrying member are foldably connected with a metal hinge.

30. A foldable building unit, comprising (a) a first frame element having a first structural load carrying member selected from the group comprising a hollow structural metal section, a metal C-channel, a metal I-beam, a metal T-beam, a metal angle beam, and a metal wide-flange beam;

(b) a second frame element having a second structural load carrying member selected from the group comprising a hollow structural metal section, a metal C-channel, a metal I-beam, a metal T-beam, and a metal wide-flange beam; provided that the first structural load carrying member and the second structural load carrying member are not both hollow structural metal sections; and (i) the first structural load carrying member and the second structural load carrying member are lengthwise connected to form a fixed connection between the first frame element and the second frame element, or (ii) the first structural load carrying member and the second structural load carrying member are lengthwise foldably connected to allow folding of the first frame element and the second frame element relative to each other; wherein the first structural load carrying member and the second structural load carrying member are affixed lengthwise to each other.

31. The foldable building unit of claim 30, wherein the first structural load carrying member and the second structural load carrying member are welded to each other or affixed with self-drilling fasteners.

* * * * *

UNITED STATES PATENT AND TRADEMARK OFFICE

CERTIFICATE OF CORRECTION

PATENT NO. : 8,739,475 B2
APPLICATION NO. : 13/814326
DATED : June 3, 2014
INVENTOR(S) : Dennis Michaud et al.

It is certified that error appears in the above-identified patent and that said Letters Patent is hereby corrected as shown below:

In The Claims

In Column 16, Claim 26, lines 40 and 41, delete "The foldable building unit of claim 1,".

Signed and Sealed this
Twenty-seventh Day of January, 2015

Michelle K. Lee

Michelle K. Lee
*Deputy Director of the United States Patent and Trademark Office*